US010465258B2

(12) United States Patent
Lekakh et al.

(10) Patent No.: US 10,465,258 B2
(45) Date of Patent: Nov. 5, 2019

(54) GRAIN REFINEMENT IN IRON-BASED MATERIALS

(71) Applicant: The Curators of the University of Missouri, Columbia, MO (US)

(72) Inventors: Simon Lekakh, Rolla, MO (US); Von Richards, St. James, MO (US); Ronald O'Malley, Rolla, MO (US); Jun Ge, Birmingham, AL (US)

(73) Assignee: The Curators of the University of Missouri, Columbia, MO (US)

( * ) Notice: Subject to any disclaimer, the term of this patent is extended or adjusted under 35 U.S.C. 154(b) by 176 days.

(21) Appl. No.: 15/567,142

(22) PCT Filed: Apr. 18, 2016

(86) PCT No.: PCT/US2016/028124
§ 371 (c)(1),
(2) Date: Oct. 17, 2017

(87) PCT Pub. No.: WO2016/168827
PCT Pub. Date: Oct. 20, 2016

(65) Prior Publication Data

US 2018/0100208 A1 Apr. 12, 2018

Related U.S. Application Data

(60) Provisional application No. 62/149,090, filed on Apr. 17, 2015, provisional application No. 62/201,786, filed on Aug. 6, 2015.

(51) Int. Cl.
*C21C 7/00* (2006.01)
*C21C 7/068* (2006.01)
(Continued)

(52) U.S. Cl.
CPC ..... *C21C 7/0006* (2013.01); *C21C 7/06* (2013.01); *C21C 7/068* (2013.01); *C21C 7/0645* (2013.01);
(Continued)

(58) Field of Classification Search
CPC ..... C21C 7/006; C21C 7/06; C21C 7/068; C21C 7/0685; C22C 33/04
See application file for complete search history.

(56) References Cited

U.S. PATENT DOCUMENTS 6,723,282 B1 4/2004 Chu et al.
2002/0048529 A1 4/2002 Kucharczyk et al.
(Continued)

FOREIGN PATENT DOCUMENTS

EP 0924313 A1 6/1999
KR 100501465 B1 7/2005

OTHER PUBLICATIONS

Shi, Caijun, "Steel Slag-Its Production, Processing, Characteristics, and Cementitious Properties." Journal of Materials in Civil Engineering. vol. 16, Issue 3, seven pages. May/June DOI:10.1061/(ASCE)0899-1561(2004)16:3(230) (Year: 2004).*
(Continued)

*Primary Examiner* — Tima M. McGuthry-Banks
(74) *Attorney, Agent, or Firm* — Stinson LLP

(57) ABSTRACT

A process for manufacturing an iron-based alloy comprising forming targeted fine oxide and/or carbide dispersoids in a melt, and sequentially precipitating transition-metal nitrides on the dispersoids for heterogeneous nucleation of equiaxed grains. An iron-based cast alloy having a highly equiaxed fine grain structure.

22 Claims, 20 Drawing Sheets

(51) Int. Cl.

| | |
|---|---|
| ***C22C 33/04*** | (2006.01) |
| ***C21C 7/06*** | (2006.01) |
| ***C22C 38/06*** | (2006.01) |
| ***C22C 38/28*** | (2006.01) |
| ***C22C 38/02*** | (2006.01) |
| ***C22C 38/04*** | (2006.01) |
| ***C22C 38/44*** | (2006.01) |
| ***C21C 7/064*** | (2006.01) |

(52) U.S. Cl.

CPC ..... *C21C 7/0685* (2013.01); *C22C 33/04* (2013.01); *C22C 38/02* (2013.01); *C22C 38/04* (2013.01); *C22C 38/06* (2013.01); *C22C 38/28* (2013.01); *C22C 38/44* (2013.01)

(56) References Cited

U.S. PATENT DOCUMENTS

| | | | |
|---|---|---|---|
| 2003/0121577 | A1 | 7/2003 | Choi et al. |
| 2004/0154707 | A1 | 8/2004 | Buck |
| 2009/0211400 | A1 | 8/2009 | Grong et al. |
| 2009/0223603 | A1 | 9/2009 | Park et al. |
| 2013/0121870 | A1 | 5/2013 | Nakajima et al. |

OTHER PUBLICATIONS

ASTM E112-13 "Standard Test Methods for Determining Average Grain Size." ASTM International. 28 pages. (Year: 2014).*

European Search Report, EP Application No. 16781004.3, dated Nov. 26, 2018, 12 pages.

International Preliminary Report on Patentability, PCT/US2016/028124, dated Oct. 17, 2017, 6 pages.

* cited by examiner

GRAIN REFINEMENT IN IRON-BASED MATERIALS

REFERENCE TO RELATED APPLICATIONS

This application is a U.S. national stage application of PCT application PCT/US2016/028124 filed Apr. 18, 2016, and claims priority to U.S. provisional application No. 62/149,090, filed Apr. 17, 2015, and U.S. provisional application No. 62/201,786, filed Aug. 6, 2015, the entire disclosures of which are hereby incorporated by reference.

FIELD OF THE INVENTION

This invention relates to refining the grain structure of iron-based materials such as cast austenitic stainless steel, white iron, non-stainless steels, low-alloy steel, and other iron-based materials.

BACKGROUND

The size and morphology of primary grains are of particular importance for physic-chemical and mechanical properties of various iron-based materials such as austenitic grades stainless steels. A typical cast macro-structure of austenitic grade stainless steels consists of columnar zone formed by elongated dendrite crystals growing from externally cooled casting surfaces and an inner zone with equiaxed grains. The ratio of equiaxed to columnar structure may be, for example, on the order of 10:90 to 55:45, e.g., between 10 and 55 vol % equiaxed structure.

Grain refinement of cast structure in iron-based materials is an important tool for: (i) reducing compositional micro segregation within grains, (ii) decreasing the large scale of macro segregation of alloying elements within entire casting, and (iii) for control of structure and composition of the grain boundaries. In general, a fine equiaxed grain structure can lead to a more uniform response in heat treatment, reduced anisotropy and better properties compared to large columnar grains. Refining structure improves both alloy strength and ductility. In high alloyed steels, the homogeneity of a fine equiaxed grain structure is better than columnar zone with elongated dendrites. Such castings exhibit reduced clustering of undesirable features, such as microporosity and non-metallic inclusions. A small equiaxed grain structure is also preferred because it promotes resistance to hot tearing.

One approach to grain refinement in austenitic stainless steels and other alloys has heretofore been to introduce pre-existing particles into the melt. The goal has been to have solid particles dispersed throughout the liquid molten metal, so that when the metal solidifies, its solidification mechanism is biased toward forming grains initiated throughout the metal over forming grains initiated from the side walls of the mold. This method of grain refinement presents various challenges in that the pre-existing particles must be formed and incorporated into a so-called master alloy which is then incorporated into the overall melt. The master alloy alters the overall composition of the melt, so careful control is required to avoid pushing the melt composition out of its specified compositional range. Also, the master alloy requires additional energy to melt, and can therefore require raising the temperature of the overall melt.

SUMMARY OF THE INVENTION

Briefly, therefore, the invention is directed to a process for manufacturing an iron-based alloy comprising, in sequence, feeding iron-bearing material into a melting furnace and melting the iron-bearing material into molten metal; introducing elements into the molten metal to react with dissolved oxygen and/or carbon in the molten metal to form targeted fine oxide and/or carbide dispersoids in the molten metal; maintaining the molten metal at a temperature above a liquidus temperature of the molten metal and introducing one or more metal grain refiner elements into the molten metal to precipitate metal nitrides of the metal grain refiner elements to yield a molten metal containing the metal nitrides; and cooling the molten metal with said metal nitrides therein to a temperature below the solidus temperature of the molten metal to form solidified iron-based alloy.

In another aspect, the invention is directed to an alloy prepared by this method.

BRIEF DESCRIPTION OF THE FIGURES

FIGS. 26, 27, 28, 29 and 30 are photographs of microstructure heat T3 as described in below Example 5.

DETAILED DESCRIPTION OF PREFERRED EMBODIMENTS

Figure 1:
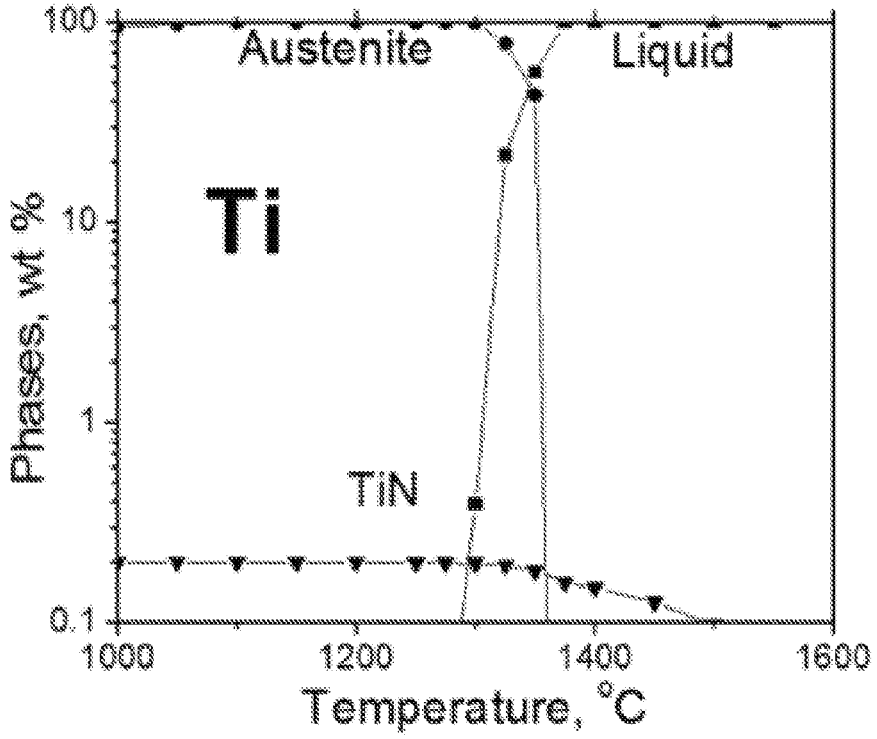
FIG. 1 is a phase diagram for prediction of precipitate formation with addition of 0.2 wt % Ti to steel.
Figure 2:
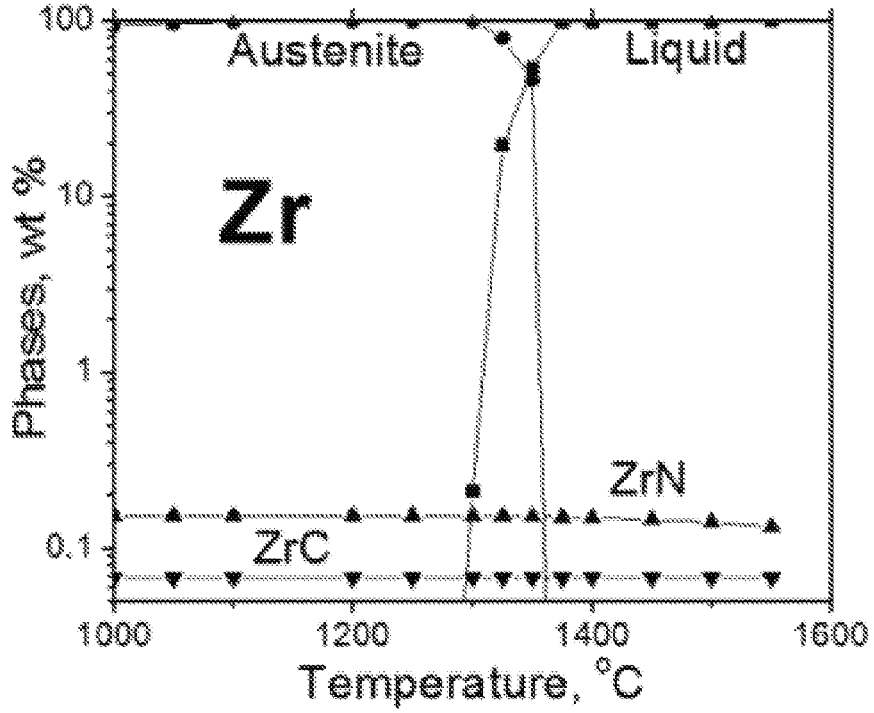
FIG. 2 is a phase diagram for prediction of precipitate formation with addition of 0.2 wt % Zr to steel.
Figure 3:
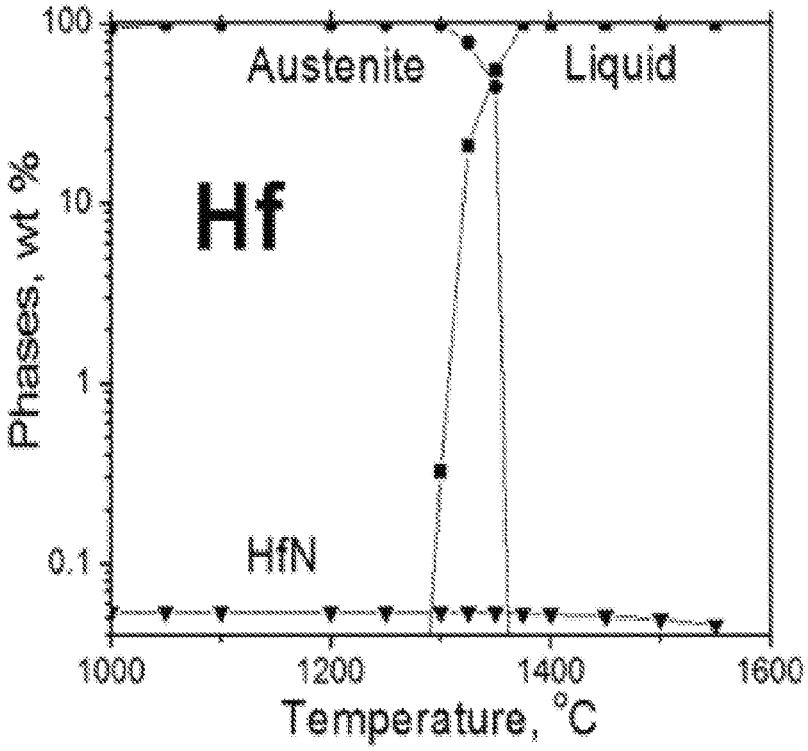
FIG. 3 is a phase diagram for prediction of precipitate formation with addition of 0.2 wt % Hf to steel.
Figure 4:
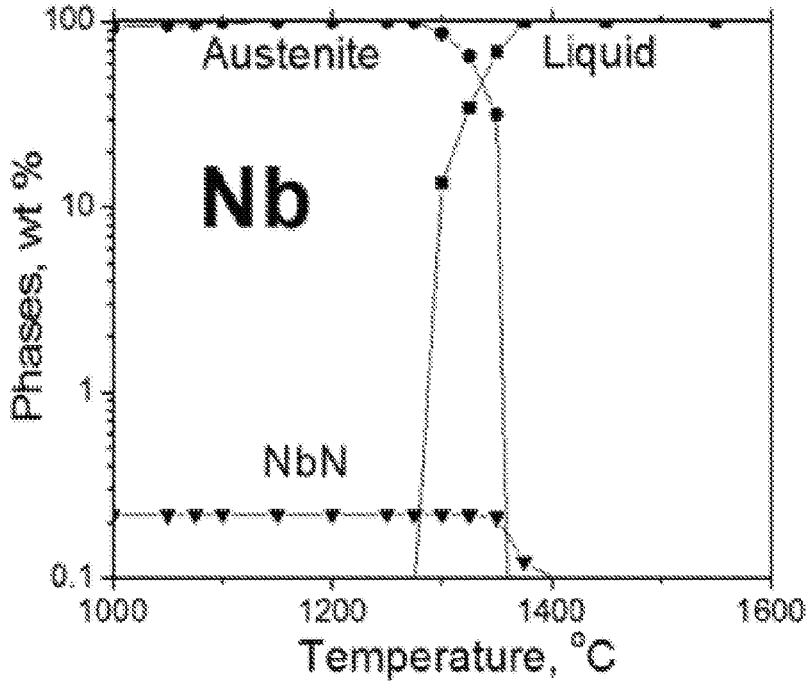
FIG. 4 is a phase diagram for prediction of precipitate formation with addition of 0.2 wt % Nb to steel.

The current invention is based on the inventors' discovery that refinement of cast grain structure can be enhanced and columnarity can be reduced by special elemental additions and controlling the order of liquid metal processing steps.

Heterogeneous nucleation refers in one sense to the initial formation of metallic grains from liquid metal on a solid surface as the molten metal cools from above its liquidus to below its liquidus. Solidification of the molten metal preferentially initiates, and therefore the formation of distinct grains preferentially initiates on solid surfaces. The present invention seeks to provide a large number of solid surfaces throughout the melt, which surfaces are highly active with respect to equiaxed grain structure initiation. The invention seeks to accomplish this in a manner which alters the overall chemical composition of the melt as little as possible. To accomplish this, the invention develops solid grain growth initiation sites in situ in the melt, which is a departure from past practices in which particles for nucleation were added to the melt as pre-existing solid particles.

At its most basic level, the invention is an improvement on an overall process that involves the steps of melting iron-bearing material such as but not limited to scrap and/or direct-reduced iron, deoxidizing, refining, and solidifying. The overall process typically includes other operations which are well known in the art but which are not narrowly critical to the invention, such as oxidizing, dephosphorizing, degassing for H and N control, alloying and other metallic additions to obtain desired melt composition, desulfurizing, and filtration. Oxidation, for example, is a normal step in the process to lower carbon content and remove impurities. Carbon is removed as CO gas. Other impurities are driven to the slag.

In a first set of operations, the iron-bearing material is melted, the chemical composition is adjusted as needed, and undesirable impurities and contaminations are removed. This yields molten iron-bearing material containing a variety of other elements such as C, Cr, Ni, Mn, Si, N, O, B, etc. in solution and secondary liquid or solid phases such as oxides and other compounds. The precise melt composition is dictated by the composition of the scrap or other source material, as well as target requirements for the eventual alloy. This first set of operations typically involves oxidation to remove C and P.

The material is then subjected to a second set of operations at the heart of the present invention which are designed for grain refinement of the cast structure during solidification. This set of operations is designed to achieve active heterogeneous nucleation sites.

In accordance with this invention, focused steps are performed sequentially. A first step is to generate fine specific dispersoid compounds as a result of targeting reactions between active additions and oxygen (or carbon) remaining in the melt. These targeted dispersoids in one embodiment include different individual or complex oxides such as oxides $MgAl_2O_4$ and/or $MgO—Al_2O_3$, and complex Mg—Al—Ca—Ti compounds formed in the melt. These oxides are easily formed in-situ in the melt as a reaction of active elements with dissolved in the melt oxygen. In an alternative embodiment, in some alloys having carbon, e.g. high-Cr cast irons, carbides also could be targeted dispersoids, for example, ZrC. These targeted dispersoids serve as pre-cursors for subsequent precipitation on their surfaces of active grain refinement agents, such as nitrides of transitional metals (Ti, Zr, Nb, Hf). The dipersoid-forming elements may include one or more of Al, Ca, Mg, Ba, and Sr, for example. Zirconium and Ce are also contemplated. The dispersoid-forming elements are selected on the basis that they tend to form oxides or carbides in the melt before the metal grain refiner elements such as Ti form nitride precipitates in the melt. They are also selected on the basis that they form dispersoids having a low surface energy with respect to TiN precipitates, and thus form dispersoids which are highly active in that they encourage TiN precipitation. And in some instances the dispersoid-forming elements are selected because they tend to form dispersoids with minimal lattice disregistry with respect to TiN. It is preferred to form dispersoids with a lattice spacing which differs by less than 5% from the lattice spacing of the particle to be precipitated thereon, such as TiN. The dispersoid elements are also selected on the basis that they form dispersoids that are have a melting point of at least about 100° C. above processing temperature. For example, in one embodiment, the dispersoids have a melting point of greater than 1700° C., such as greater than 1800° C., because the melt processing temperature of about 1600° C. is used. In one embodiment illustrated as case T2 below, these elements include Al and Ca. When added to the melt, these form Al oxides and Ca oxides, which serve to combine with oxygen from the melt to form the targeted oxides. In another embodiment illustrated as case T3 below, these elements are Al, Ca and Mg that form spinel compounds of magnesium aluminate ($MgAl_2O_4$ and/or $MgO—Al_2O_3$) and MgO. Spinel $MgAl_2O_4$ is a preferred dispersoid because it is chemically stable in molten steel and has minimal lattice parameter disregistry with respect to TiN.

The first step of forming dispersoids is performed by introducing the dispersoid-forming elements into the molten iron-bearing material which form oxide compounds with oxygen remaining in the melt, or which form carbide compounds with carbon in the melt. This operation of forming the targeted disersoid compounds in one embodiment is performed at a temperature on the order of 150 to 200° C. above liquidus, such as 1520-1620° C. for Cr—Ni austenitic steel. Preferably, mixing is performed on the melt during the additions.

The mean particle size of the dispersoids in a preferred embodiment is between 0.1 and 10 μm, such as between 0.5 and 2 μm. Particle size in this context refers to diameter for spherical particles and largest straight dimension across for irregular particles. The minimum particle size is limited by solid boundary stability in the melt and critical size for homogeneous precipitation. Forming dispersoids with a particle size above 10 μm is preferably avoided because above that size, the precipitates tend to float to the top of the melt and segregate.

The target dispersoid concentration is preferably between about 1 and 1000 ppm by volume, such as between about 10 and about 100 ppm by volume. Excessive dispersoid formation is preferably avoided because excess precipitates can negatively impact ultimate alloy toughness and cleanliness. The specific amount of the dispersoid-forming elements of Al, Ca, Mg, Ba, Sr, Zr and/or Ce added in this step is a routine calculation for one skilled in the art driven primarily by the target dispersoid composition (e.g., $MgAl_2O_4$ and/or $MgO—Al_2O_3$) and concentration (e.g., 50 ppm by volume), taking into account typical recovery ratios of added Mg, Al etc. considering vaporization losses, concentration of such elements in the melt prior to addition, temperature, and oxygen/carbon concentration in the melt. In the working examples herein, for example, the additive concentrations were calculated assuming recovery ratios for Al, Ba, and Ca of more than 70% and on the order of 30% for Mg.

While the invention in one embodiment involves creating targeted oxide precipitates, it is also important to not overload the melt with clustered oxides. Accordingly, it is within the scope of this invention to preliminary partially deoxidize to remove excess oxide-based reaction products into slag. This preliminary deoxidizing may be performed directly in an melting furnace (induction or electric arc) in which the melt is formed with controlling final oxygen activity to on the order of, for example, 10-15 ppm.

After adding the dispersoid-forming elements of one or more of Al, Ca, Mg, Ba, Sr, Zr and Ce, for example, the adding the dispersoid-forming elements is terminated. In a preferred embodiment, the melt is then subjected to a short dwell time prior to the next substantial operation of adding one or more grain-refining agents. The kinetics of forming certain dispersoid oxides such as spinel are so fast (less than 1 second) that a dwell time is not narrowly critical to all embodiments of the invention, though a dwell time is preferred in many embodiments. This dwell time may be, for example, on the order of 10 seconds to up to five minutes or more, such as about 10 to about 60 seconds, or about 10 to about 30 seconds, to allow the forming of the targeted dispersoid elements to run its course and come to completion or near completion.

After forming the targeted dispersoid precipitates (e.g., oxides of Al, Ca, Mg etc), one or more grain refining elements are added to the molten metal. The metal at this stage is still at a temperature above its liquidus, e.g., about 50-150° C. above liquidus. Because the metal is still fully molten, metal grains have not yet started to form. Upon addition of grain refining elements such as Ti, the targeted dispersoid precipitates formed in situ promote precipitation of nitrides such as TiN on their surfaces, and these activated complexes subsequently serve as nucleation sites for grain formation in casting upon cooling. The specific amount of the transition metal grain refining element such as Ti, Hf, Nb, and/or Zr added in this step is a routine calculation driven by factors such as concentration of refining elements in addition (master alloy or ferroalloys, typically from 10 to 70 wt. %), recovery of these elements (typically above 70%) and nitrogen concentration in the melt to form nitrides at temperature above liquidus of the alloy. Thermodynamic software as described herein is preferably used to account for possible reactions in the melt.

The precipitation occurs in steps—the oxide (or carbide) nuclei must be present first, and then the nitride forms on the oxide (or carbide). The number of nucleation sites therefore determines the number of nitrides formed. This is especially advantageous because enhanced nucleation of nitrides leads to, upon cooling, enhanced grain refinement. The preferred grain refining elements used in accordance with this invention in one embodiment where the iron-based material is austenitic stainless steel are preferably transition metals, more preferably one or more of Ti, Zr, Hf, and/or Nb, with Ti preferred in the current embodiment shown in cases T1, T2, and T3 below. In one embodiment of the invention, the grain refining elements are added to the molten metal in the specific absence of any oxide or dispersoid removal operation between the dispersoid-forming step and the step of adding the grain refining elements.

Once the grain-refining elements are added, adding the grain-refining elements is affirmatively terminated, and there is a dwell time to facilitate nucleation. The conditions of temperature and time are a function of the solution thermodynamics and the concentration of refining elements. In one embodiment, for example, after the grain refining element addition, the melt is maintained at a temperature of between 50 and 200° C. above its liquidus for a dwell time of between about 1 and about 20 minutes, such as for between about 2 and about 5 minutes.

The molten metal is thereafter cooled to form solid metal. Some cooling occurs during ladle hold time, and the rest upon casting (continuous or into distinct molds).

In accordance with this invention, castings of iron-based material such as white iron, stainless steel, non-stainless steel, or low-alloy steel are produced which have an equiaxed grain size of less than 2 mm, such as less than 1 mm such as in the range of 0.3 to 1 mm. Such castings also can be produced which have a columnar zone of less than about 10 mm. Such castings also are at least about 60% equiaxed structure by volume, and typically at least 70 or 80 vol % equiaxed structure.

The following non-limiting examples further illustrate the invention.

Example 1

This first example demonstrates the invention by simulated assessment of the reaction sequence and formation of targeted precipitates in the molten metal. Grain refinement of cast super-austenitic stainless Cr—Ni—Mo alloyed steel was investigated. Table 1 shows the steel composition:

TABLE 1

| Composition super-austenitic stainless steel, balance Fe, wt. %. | | | | | | | | |
|---|---|---|---|---|---|---|---|---|
| Cr | Ni | Mo | Cu | Mn | Si | C | N | O |
| 19.4 | 18.4 | 6.5 | 0.7 | 0.5 | 0.6 | 0.01 | 0.04-0.05 | 0.02-0.03 |

FactSage 6.3 (CRCT, Montreal, Canada and GTT, Aachen, Germany) software was used to predict solidification characteristics. The FSstel database for the liquid and solid solutions, and pure compounds (dispersoids) was chosen for equilibrium calculations based on the principle of minimization of Gibbs free energy.

This alloy solidifies with formation of a primary austenite phase. Alloying element segregation (positive for Cr and Mo and negative for Ni) promote the formation of gamma and Laves phases at lower temperatures by solid/solid reaction at the grain boundaries. These segregates and precipitates play an important role in corrosion resistance and mechanical properties of super austenitic steel.

The method employed was based on direct, in situ, formation of targeted precipitates in the melt by chemical reactions between the active additions and the dissolved components, rather than using the conventional technique of adding a master alloy containing pre-formed dispersoids. The formation of different thermodynamically stable solid precipitates in the melt at the temperatures above the solidification region was analyzed with FactSage 6.3 software. Complex additions and several active elements in the melt could react with multiple reaction products. The possible effects of melt treatment sequence were determined using two assumptions: (i) free energy minimization of all potential reactions, including the possible reverse transformation of firstly formed reaction products during the subsequent treatment step, and (ii) assuming irreversible reactions and high stability of initially formed precipitates during subsequent treatment.

In the first set of simulations, the stability of targeted nucleation sites (nitrides or carbides of transitional metals) in the melt after single-step additions of transition metals Zr, Hf, and Nb was analyzed. Considering the concentrations of C, N, and O in the steel (Table 1), there are several possible parallel reactions that can occur depending on type of addition and temperature. If the targeted compounds (nitrides or carbides) started to precipitate before the liquid-solid transformation, they could be potential nucleation sites. On the other hand, if the targeted compounds formed during or after Fe-fcc solidification, then they had less or no ability to trigger heterogeneous nucleation.

Calculations demonstrated in FIGS. 1 through 4 show that targeted nitrides and carbides of transition metals can be formed directly in the melt above the solidification temperature only after completion of the de-oxidation reactions, and require a large critical amount of additions. This critical value of addition represents the minimal amount needed to be added into the melt in order to start forming targeted compounds. The critical values varied for different types of transition metals and for the different levels of impurities in the melt. For instance, more than 3% Nb addition must be present to form NbN at the temperature above liquidus in the studied steel, as contrasted with just on the order of 0.1 to 0.2% Ti or Zr and on the order of 0.2 to 0.3% Hf. In most of the cases, oxide formation had already taken place in the melt when the transition metal was added. Once deoxidation was completed, the remaining transition metal was able to react with nitrogen and/or carbon to form the targeted compound.

Table 2 shows calculated weight percentages of transition metals needed to be added to melts having different nitrogen concentrations to develop the same volume (0.05 vol. %) of active nucleation sites (nitrides and carbides of transition metals):

TABLE 2

Calculated critical additions of TM into the melt (0.03 wt. % O for two levels of nitrogen 0.05 wt. % and 0.15 wt. %) to form 0.05 vol. % (i.e., 500 ppm) of targeted phases.

| | TM | | | | | | | |
|---|---|---|---|---|---|---|---|---|
| | Ti | | Zr | | Hf | | Nb | |
| | Targeted phases | | | | | | | |
| | TiN | | ZrN + ZrC | | HfN | | NbN | |
| Initial N in melt, wt. % | 0.05 | 0.15 | 0.05 | 0.15 | 0.05 | 0.15 | 0.05 | 0.15 |
| TM addition, wt. % to form 0.05 vol. % of targeted precipitates | 0.13 | 0.09 | 0.14 | 0.13 | 0.24 | 0.25 | — | 3.03 |

These data were calculated using Thermodynamic software FACTSAGE. Free Gibbs energy minimization principles were used to calculate final equilibrium from initial conditions, included melt chemistry and additions. The same method was used to simulate all in situ reactions and formed products. Therefore, it was determined that primary de-oxidation may be employed to decrease the amount of transition metal additions necessary to form targeted compounds. In evaluating this, TiN was chosen as the targeted compound because it has potential for triggering heterogeneous nucleation in Cr-alloyed steels. Controlling reactions in the melt by controlling treatment sequences can also be used to enhance formation of target compounds.

Example 2

This example demonstrates the invention by simulated assessment of molten metal treatment sequences. A base melt and three different melts of the invention with complex additions (Al, Ca, Mg, Ti) were subject to thermodynamic simulations. The goal was to predict the effect of the melt treatment sequences on dispersoid formation in the melt (Table 3). These melts were also prepared and evaluated in experimental heats (Example 3).

TABLE 3

Simulated cases and experimental heats.

| | | Treatment | |
|---|---|---|---|
| Heat # | N, ppm | First (in furnace) | Second (in ladle) |
| B | Low (400) | — | Al, Ca |
| T1 | High (1200) | Ti | Al, Ca |
| T2 | High (1200) | Al, Ca | Ti |
| T3 | Moderate (800) | Ca | Al, Mg, followed by Ti |

Figure 5:
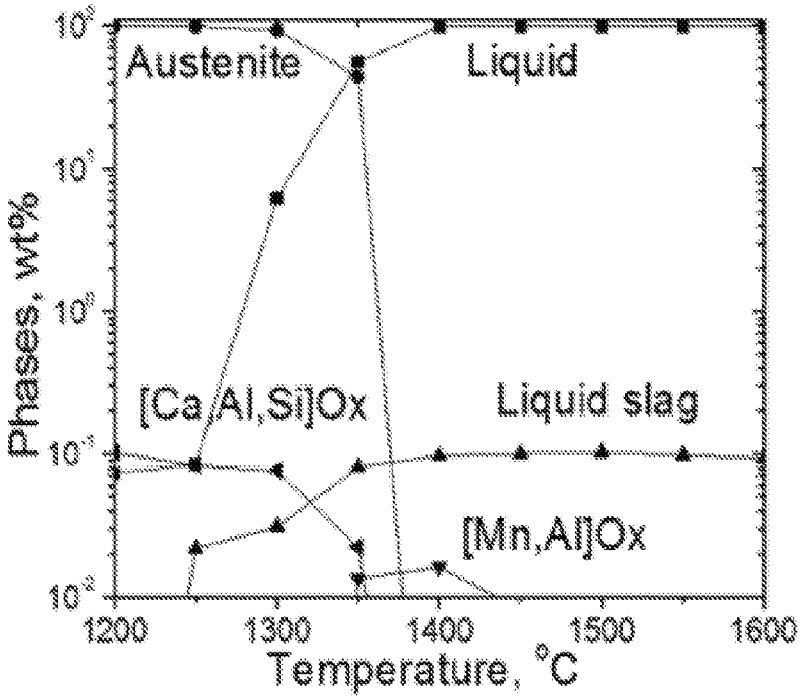
FIGS. 5 through 8 are phase diagrams for prediction of precipitate formation in accordance with below Example 2.
Figure 6:
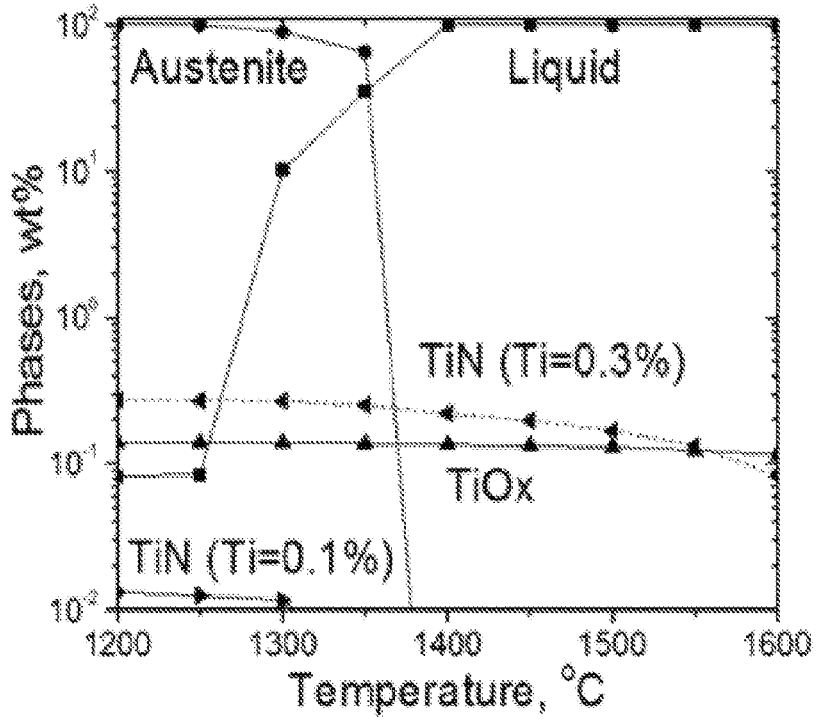

In the base case (B), superaustenitic steel with low N was deoxidized by Al and Ca additions, and no Ti additions were used. FIG. 5 illustrates the calculated results for the base case B, indicating that the main de-oxidation product is a complex liquid slag phase, mainly constituted with $Al_2O_3$, CaO, and $SiO_2$. The effect of changing the sequence for de-oxidizing treatment using Al and Ca additions and refining treatment with Ti addition was investigated in the cases T1 and T2. In case T1, Ti was added to the melt at first and Al and Ca were added after completion of reaction of impurities with Ti. The final equilibrium showed that calcium titanate and calcium aluminate were formed as stable phases at the beginning of solidification, as shown in FIG. 6. TiN precipitates only form after the start of solidification.

Figure 7:
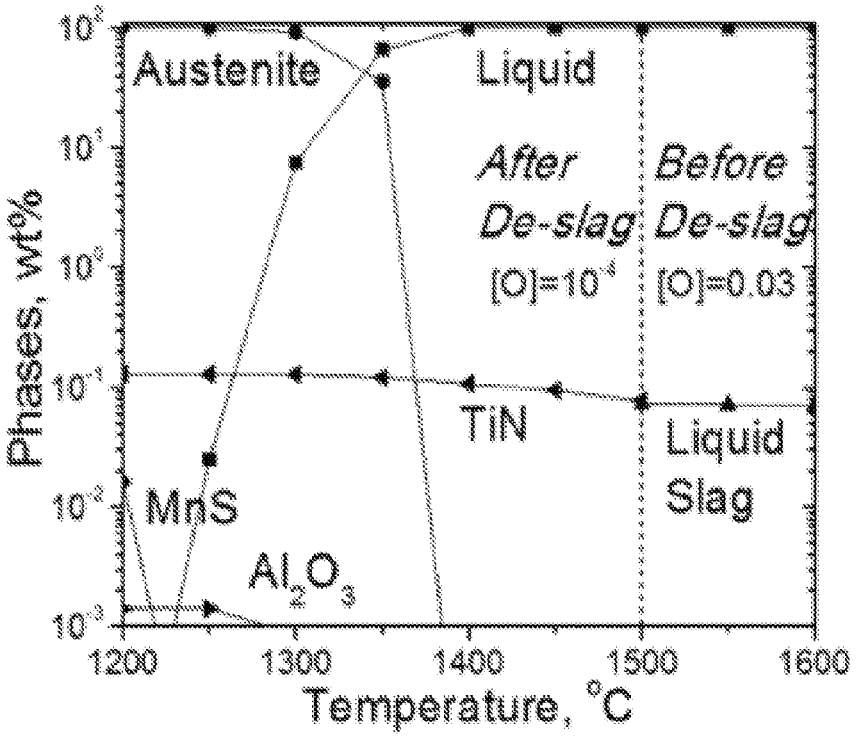

In the case T2 illustrated in FIG. 7, the Al and Ca deoxidizers were introduced first allowing them to form liquid reaction products which could be removed from the system into slag before Ti addition. After deoxidation and virtual de-slagging in thermodynamic calculation, the total oxygen content decreased substantially allowing TiN to be formed as stable phase with a higher amount and at a higher temperature compared to that in the case T1.

Figure 8:
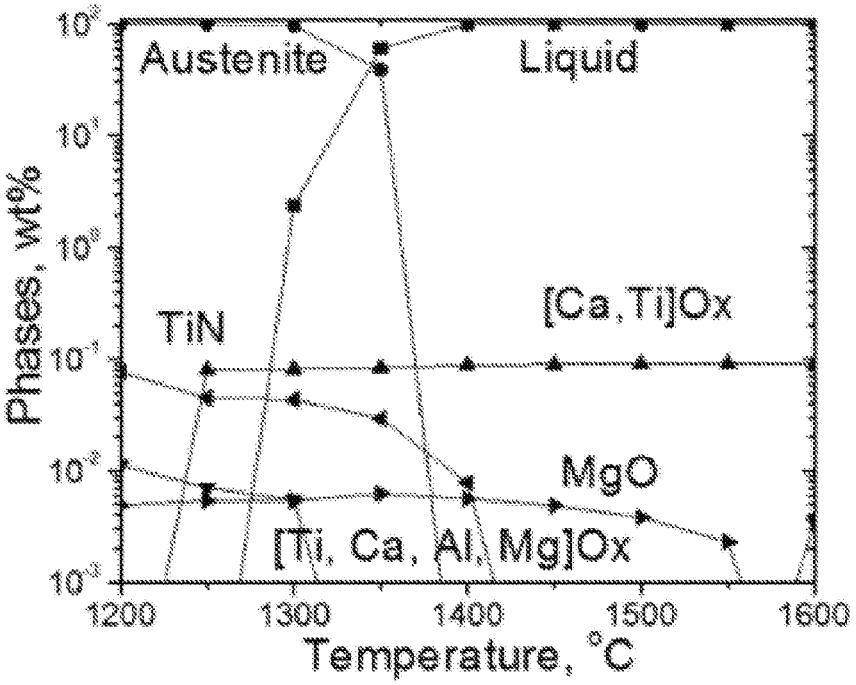
Figure 9:
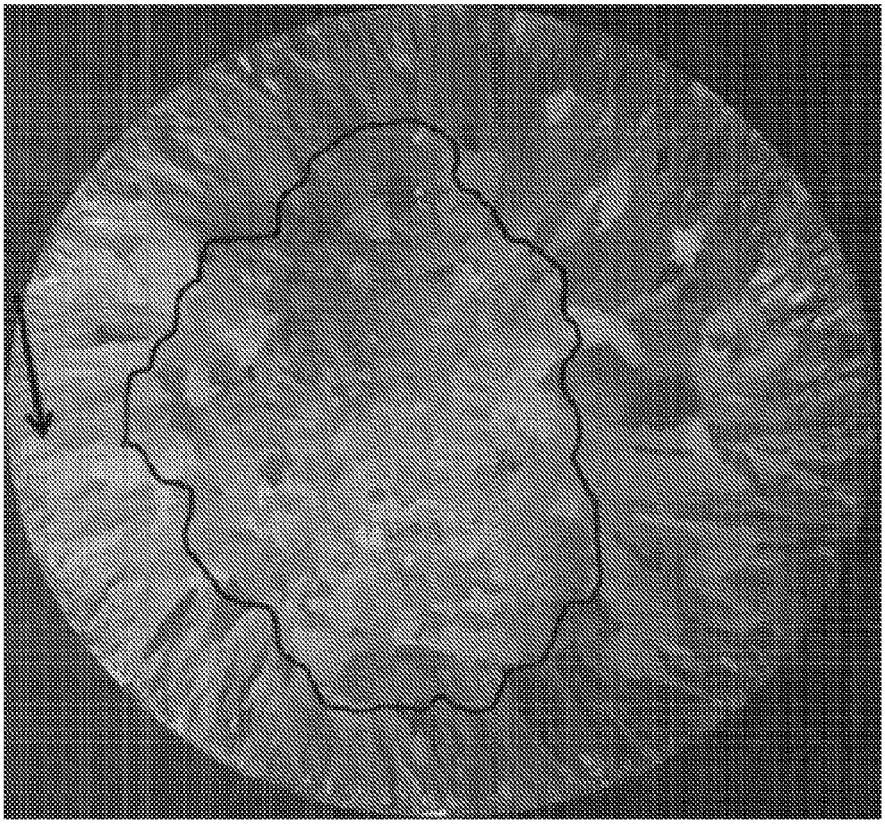
FIG. 9 is a photograph showing the microstructure of heat B in below Examples 2 and 3, in horizontal cross section.
Figure 10:
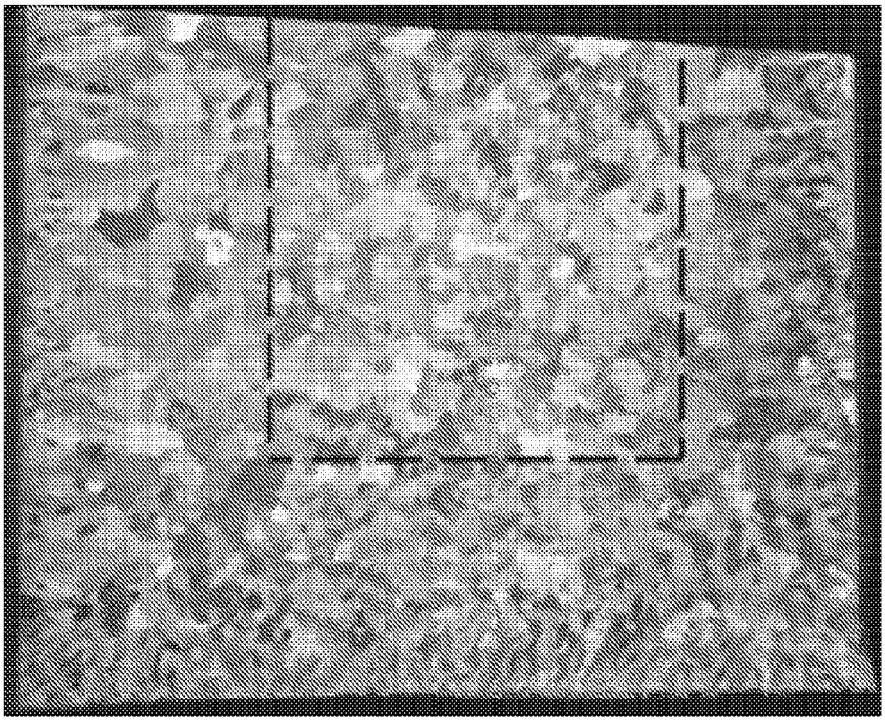
FIG. 10 is a photograph showing the microstructure of heat B in below Examples 2 and 3, in vertical cross section.
Figure 11:
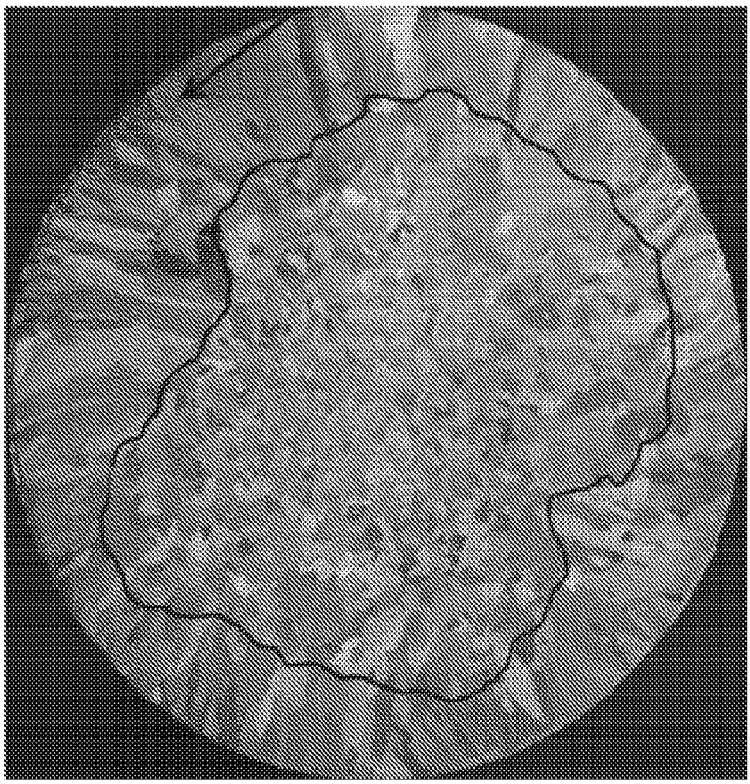
FIG. 11 is a photograph showing the microstructure of heat T1 in below Examples 2 and 3, in horizontal cross section.
Figure 12:
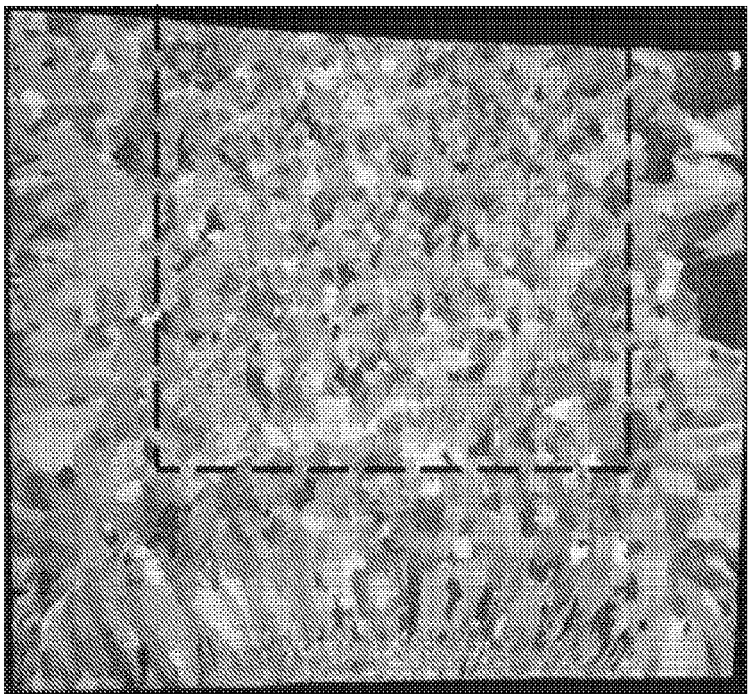
FIG. 12 is a photograph showing the microstructure of heat T1 in below Examples 2 and 3, in vertical cross section.
Figure 13:
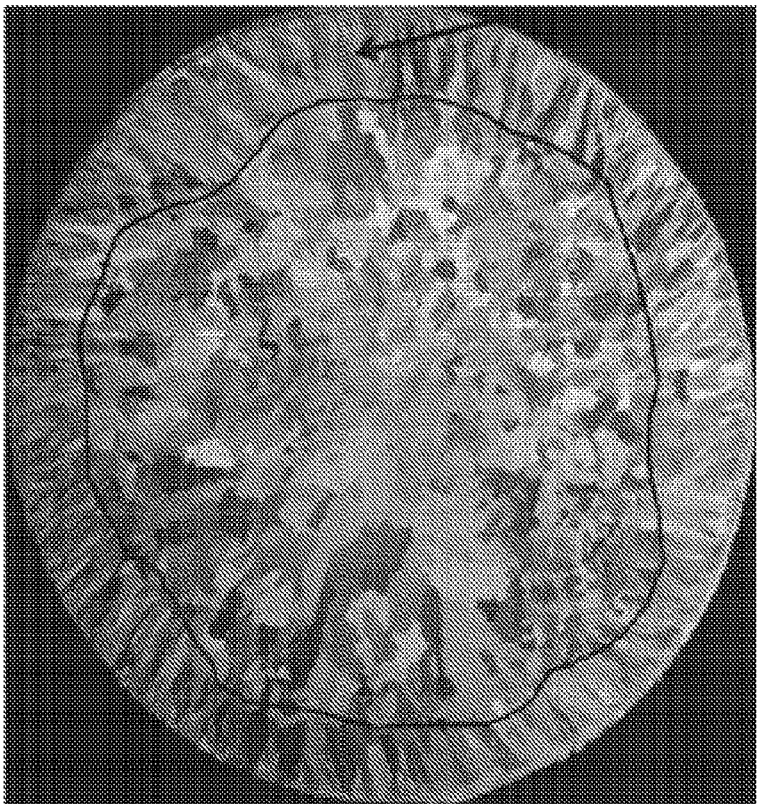
FIG. 13 is a photograph showing the microstructure of heat T2 in below Examples 2 and 3, in horizontal cross section.
Figure 14:
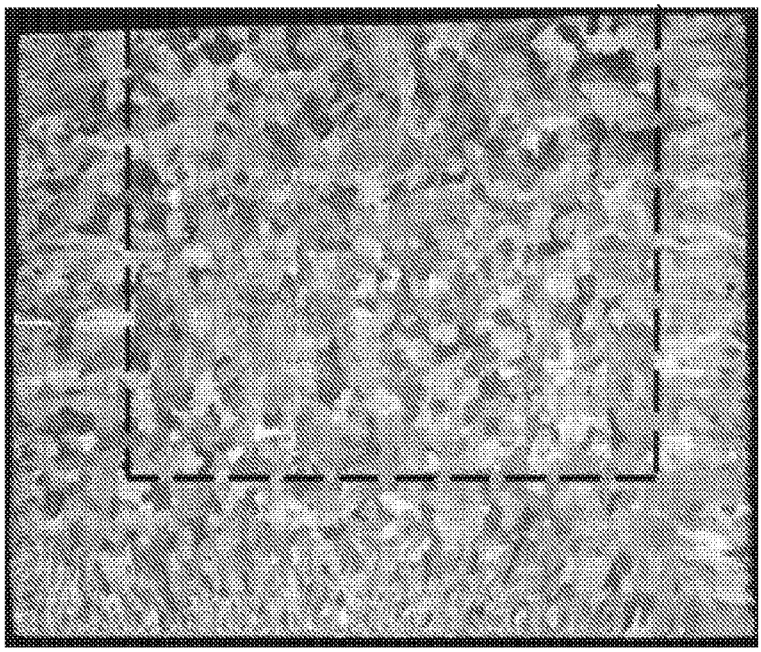
FIG. 14 is a photograph showing the microstructure of heat T2 in below Examples 2 and 3, in vertical cross section.

In order to enhance sequential precipitation of the targeted TiN nuclei onto the previously precipitated oxides (Al—Mg spinel or MgO), a complex treatment by Al—Ca—Mg additions before Ti refining additions was simulated in case T3, illustrated in FIG. 8. Calculations predicted the formation of Al—Mg spinel and more complex Al—Mg—Ti—Ca spinel at first, followed by TiN formation later during cooling. At temperatures above solidification, these oxides precipitated in the prior treatment step have the potential to increase heterogeneous nucleation efficiency by influencing TiN nucleation before matrix alloy solidification begins.

Example 3

This example demonstrates the invention by experiment. Experimental heats of super-austenitic steel were produced in a 100 lb induction furnace with nitrogen gas purging. Consistent charge based on pre-melted steel ingots of the composition shown in Table 1 was used in all heats. Experiments with designed additions and de-slagging sequences were performed following the steps used in the thermodynamic calculations in Example 2, namely:

TABLE 3a

Simulated cases and experimental heats.

| Heat # | N, ppm | Treatment | |
|---|---|---|---|
| | | First (in furnace) | Second (in ladle) |
| B | Low (400) | — | Al, Ca |
| T1 | High (1200) | Ti | Al, Ca |
| T2 | High (1200) | Al, Ca | Ti |
| T3 | Moderate (800) | Ca | Al, Mg, followed by Ti |

The heavy section cast shape was a vertical cylinder with 4" diameter and 8" height and top riser with 6" diameter and 4" height. To achieve moderate mixing in the mold, a bottom-fill gating system was applied. Mold design was supported by solidification simulation using MAGMAsoft to avoid centerline porosity. The pouring temperature for all these heats was around 1500° C. with approximately a 100° C. superheat above the liquidus temperature for the steel grade studied.

Representative castings were sectioned and macro-etched. In order to examine the grain size, the mixture of ten parts of the hydrochloric acid and one part of concentrated hydrogen peroxide was applied to etch the macrostructure. The studied cross sections were a horizontal section at 4" from the casting bottom and vertical section of the remaining bottom part. Macrostructure photos were taken under light with blue and red filters.

Figure 15:
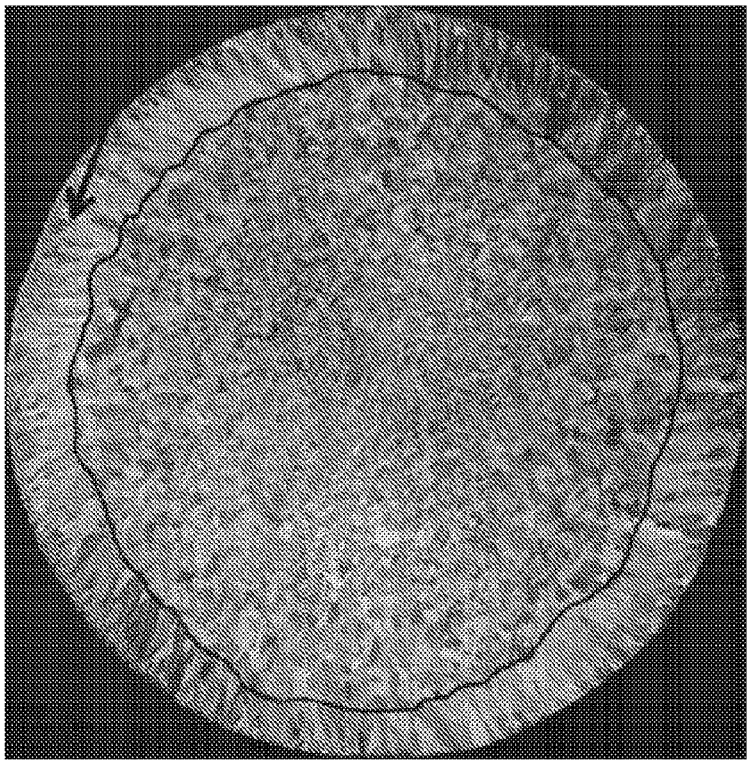
FIG. 15 is a photograph showing the microstructure of heat T3 in below examples 2 and 3, in horizontal cross section.
Figure 16:
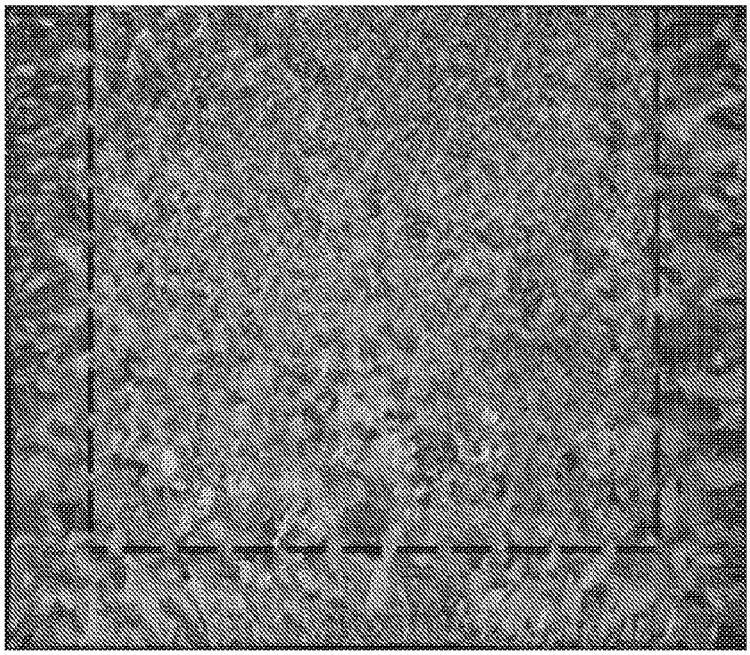
FIG. 16 is a photograph showing the microstructure of heat T3 in below Examples 2 and 3, in vertical cross section.

FIGS. 9 through 16 show the macrostructures of the horizontal and vertical cross sections for the experimental heats. The black arrows identify the direction of the liquid steel flow entering into the mold cavity. In the base heat illustrated in FIG. 9 (horizontal cross section) and FIG. 10 (vertical cross section), a large asymmetrical columnar zone with restricted area of equiaxed zone, having moderate size grains, was observed in both horizontal and vertical cross sections. In comparison to the base heat of FIGS. 9 and 10, the heats with Ti additions (T1—FIGS. 11 and 12; and T2—FIGS. 13 and 14) had a shorter columnar zone and a somewhat smaller grain size in the equiaxed zone. Comparing the structure of T2 to that of T1 demonstrates that adding the precursors for formation of targeted dispersoids in heat T2 prior to adding the precursor for grain-refining nitrides had a marked impact on microstructure. The distinct sequence of the invention—forming targeted dispersoids, followed by forming the nitrides only after forming the targeted dispersoids has completed—yields a more refined, more equiaxed grain structure. Also, a larger inhomogeneity of macro structure was observed in the heat T2. This may be affected by the flow pattern. A large symmetrical equiaxed zone with fine grains was achieved in the heat T3, as shown in FIGS. 15 and 16.

Comparing the macro-structure of T3 to that of T2 demonstrates that the sequential precipitation of TiN on the Mg-bearing oxides such as MgO and $MgAl_2O_4$ spinel oxide dispersoids formed previously in the melt provided large effective and well dispersed surface area for heterogeneous nucleation of austenite The active heterogeneous nuclei promote formation of equiaxed grains in the melt in front of growing dendrites in the heat-sink direction. At a critical volume and proportion of equiaxed grains, growth of columnar dendrites is interrupted and a dominant equiaxed zone was formed in the cast structure. To facilitate this grain refining mechanism, therefore, the sequence of treatments in heat T3 provided a large number of high surface area nucleation sites.

The vertical cross sections of FIGS. 10, 12, 14, and 16 illustrate the grain size distribution in the equiaxed zone and the columnar/equiaxed structure transition. The effect of the chilling zone can be observed at the bottom and also the sides of the section face. The dashed line marks the approximate location of the equiaxed zone that has evenly distributed grains.

Example 4

This example was performed to quantitatively assess cast structure. According to ASTM standard E112-10, a lineal intercept method was adopted for calculation of the grain size in the equiaxed zone. The length of the columnar zone was measured for at least 12 lines from the boundary between equiaxed and columnar zone to the edge of the cross section. A grain refining factor (R) was used as a parameter to quantify the structure refinement (R=0 for fully columnar structure and R=1 for fully refined structure with equiaxed grains):

$$R = \frac{(D - 2 \times L_{columnar})}{D}$$

where D is the casting diameter and $L_{columnar}$ is the length of columnar zone.

Table 4 lists the grain refinement measurements in the horizontal cross sections of the experimental heats.

TABLE 4

Grain refinement parameters in experimental castings

| Refining Parameters | Heats | | | |
|---|---|---|---|---|
| | B1 | T1 | T2 | T3 |
| Equiaxed grain size, mm | 2.4 ± 1.1 | 2.0 ± 0.7 | 2.2 ± 2.1 | 0.5 ± 0.3 |
| Columnar zone length, mm | 22.2 ± 11.1 | 13.8 ± 0.6 | 11.0 ± 0.5 | 8.6 ± 1.4 |
| R | 0.55 | 0.72 | 0.78 | 0.82 |

It can be seen that the grain refinement technique of the invention yields significant improvements in reduction of columnar zone length, and in reduction in equiaxed grain size. The R parameter of equiaxed structure was 0.82 in heat T3, as compared to only 0.55 in the base heat B1. This ratio means that with the invention, much more of the metal solidifies as equiaxed grains. In combination with grain size, this refined grain structure provides uniform chemistry and properties, even in heavy section casting.

Example 5

This example provides detailed analysis of the precipitated dispersoids. An automated SEM/EDX analysis was used for evaluation of dispersoid population. The samples were cut for the experimental castings at ½ diameter in horizontal section at 100 mm from the bottom. Automated Feature Analysis provided an average chemistry of individual precipitates, therefore statistical data of precipitate chemistry were presented in the joint ternary diagrams, where each ternary plot presents precipitates having three major elements and each precipitate was presented only once. Markers were used to differentiate average diameters.

Figure 17:
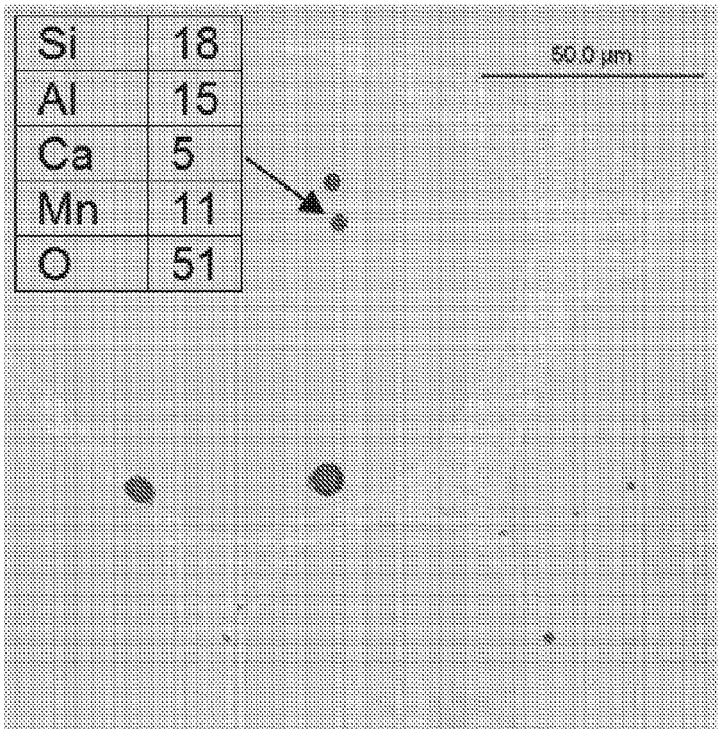
FIGS. 17 and 18 are photographs of microstructure in base heat B as described in below Example 5.
Figure 18:
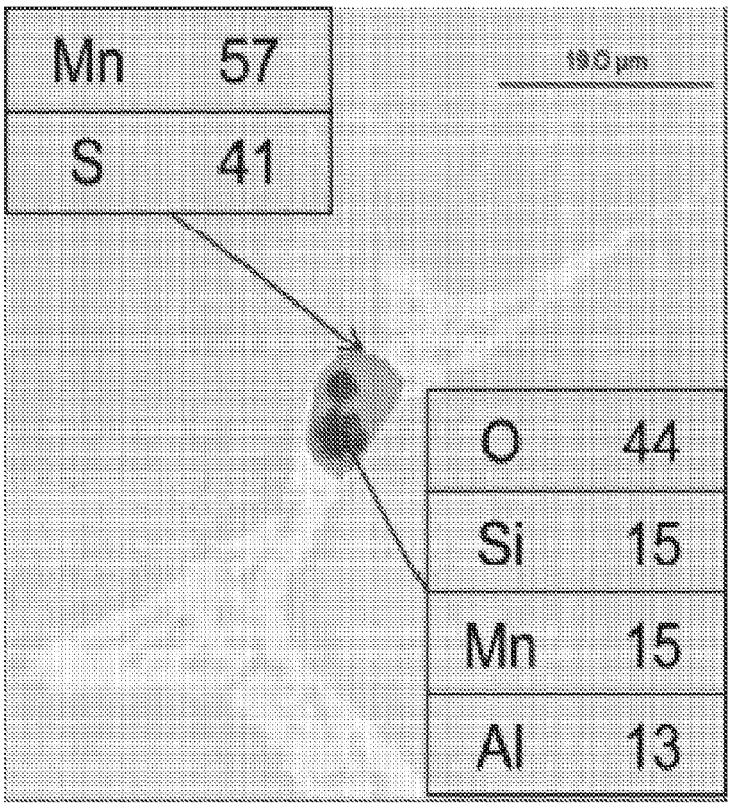
Figure 19:
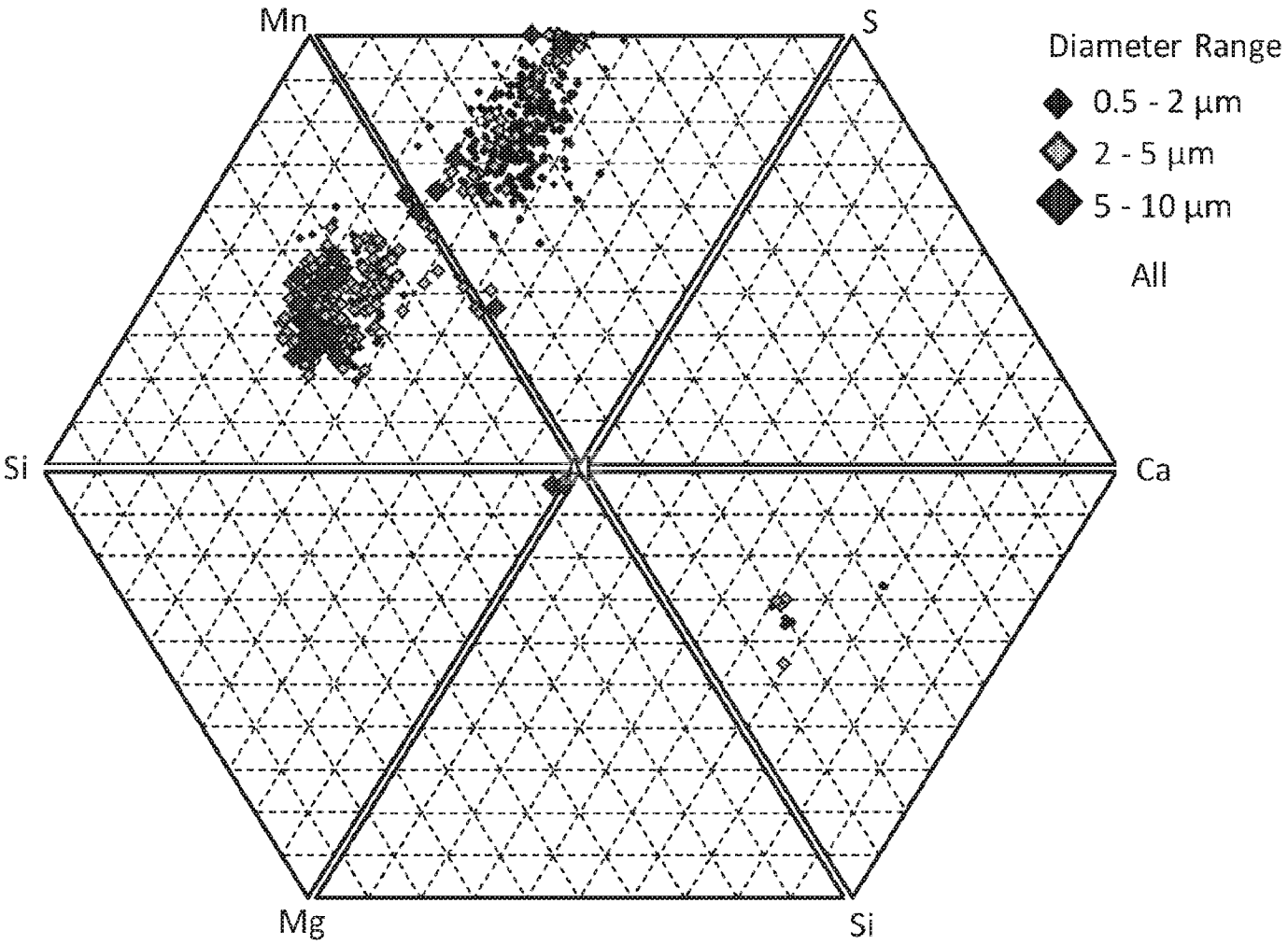
FIG. 19 is a joint ternary plot of precipitate composition in base heat B as described in below Example 5.

The solid dispersoids deliberately formed in accordance with this invention in a step independent of and prior to transition element addition, which dispersoids are formed in situ by reaction of Mg, Al, Ca etc. additions with certain active elements in the melt (namely, O and/or C) are hereby shown to play an important role in grain refinement of as-cast structure, by leveraging them to provide heterogeneous nucleation sites. Precipitate populations were characterized using ASPEX SEM/EDX analysis and selected precipitates were analyzed individually. The common nonmetallic precipitates observed in the base heat B were evenly distributed complex Al—Ca—Si—Mn oxides as shown in FIG. 17, and MnS sulfides located at dendrite boundary as shown in FIG. 18. Oxides were found in the center of the dendrites and also at the interdendritic regions. The majority of precipitates had complex structure as a result of sequential co-precipitation from the melt, as can be understood from the joint ternary plot of precipitate composition of FIG. 19.

Figure 20:
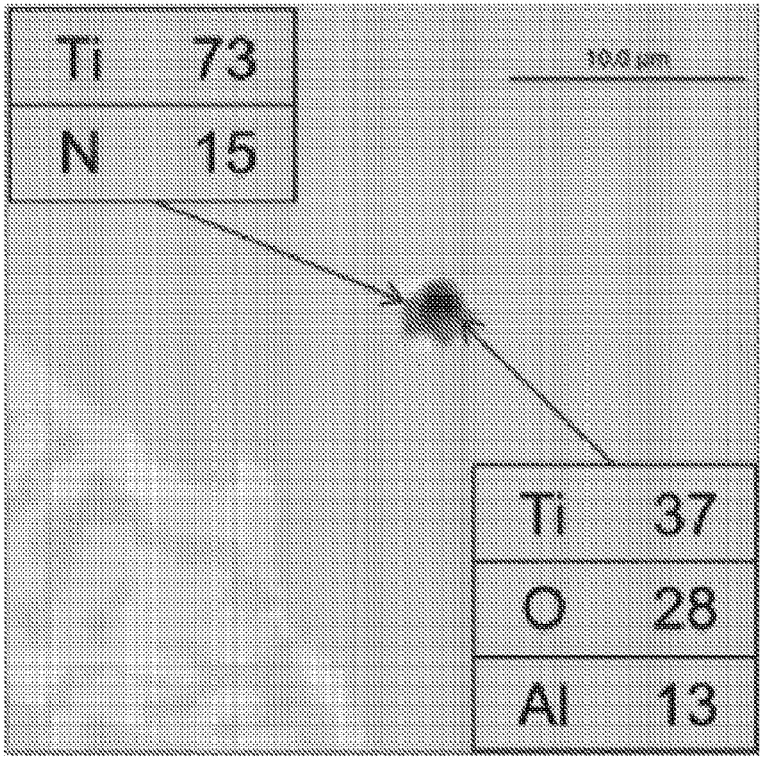
FIGS. 20 and 21 are photographs of microstructure heat T1 as described in below Example 5.
Figure 21:
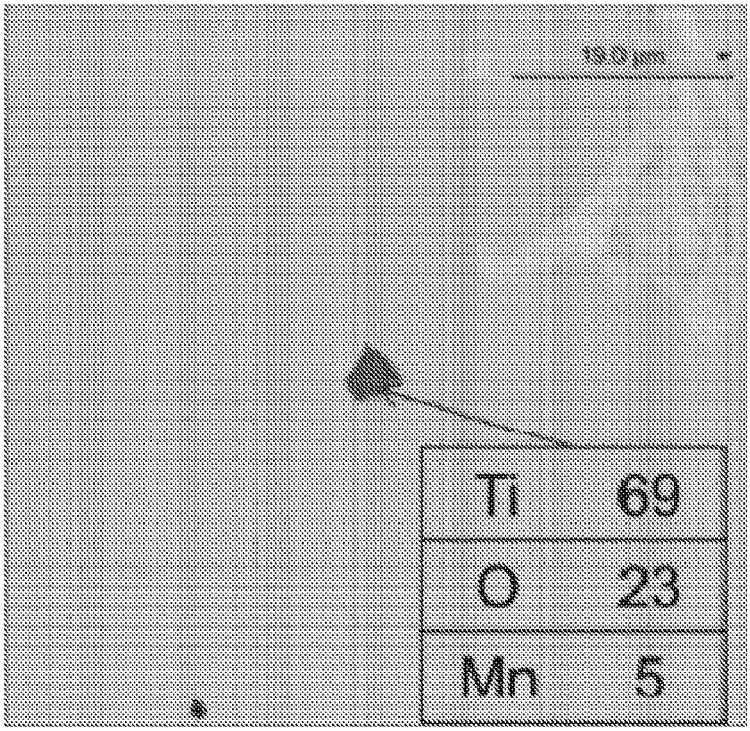
Figure 22:
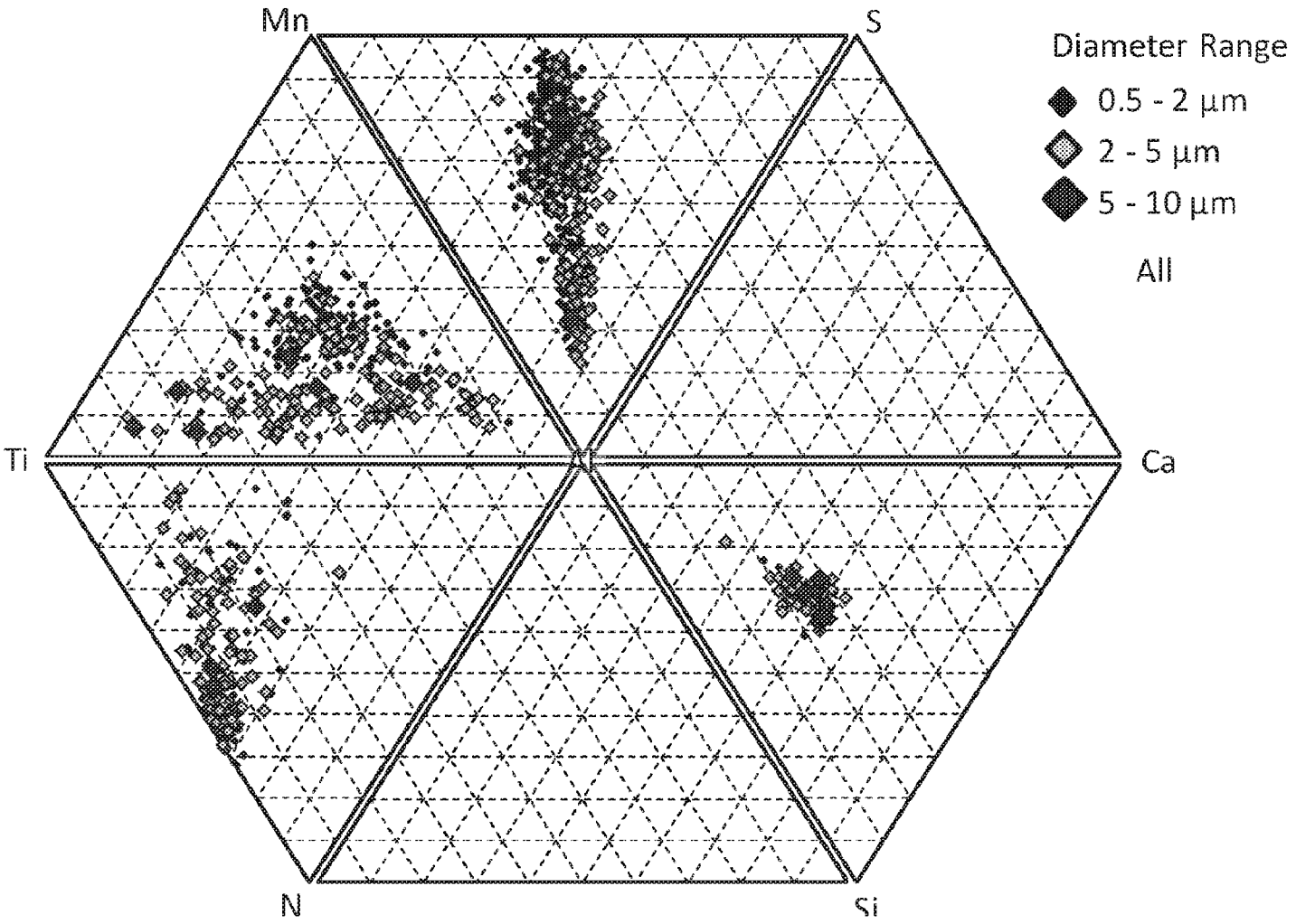
FIG. 22 is a joint ternary plot of precipitate composition in heat T1 as described in below Example 5.

In heat T1, first treated by titanium followed by treatment with Al+Ca, there were several types of complex nonmetallic precipitates: TiN, which typically precipitated on different oxide cores as shown in FIG. 20, Ti—Mn—Al and Al—Si—Ca complex oxides (FIG. 21), and MnS with alumina cores precipitated in interdendritic regions. Most of the sulfide precipitates had 0.5-5 micron diameter, while precipitates with TiN had 2-5 microns, and the more complex liquid oxides Al—Si—Ca oxides were larger size (FIG. 22).

Figure 23:
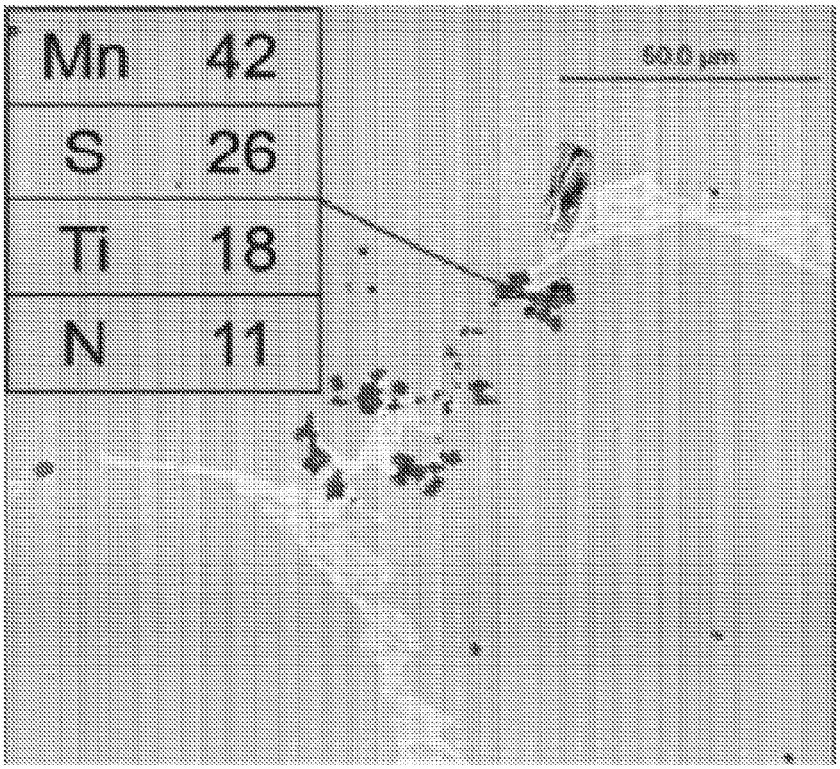
FIGS. 23, 24 and 25 are photographs of microstructure heat T2 as described in below Example 5.
Figure 24:
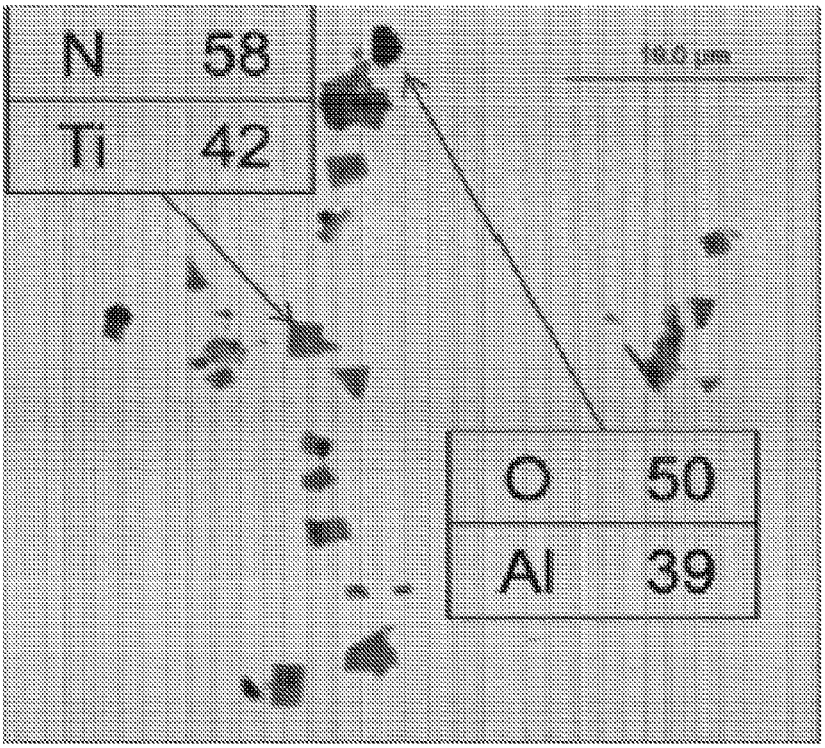
Figure 25:
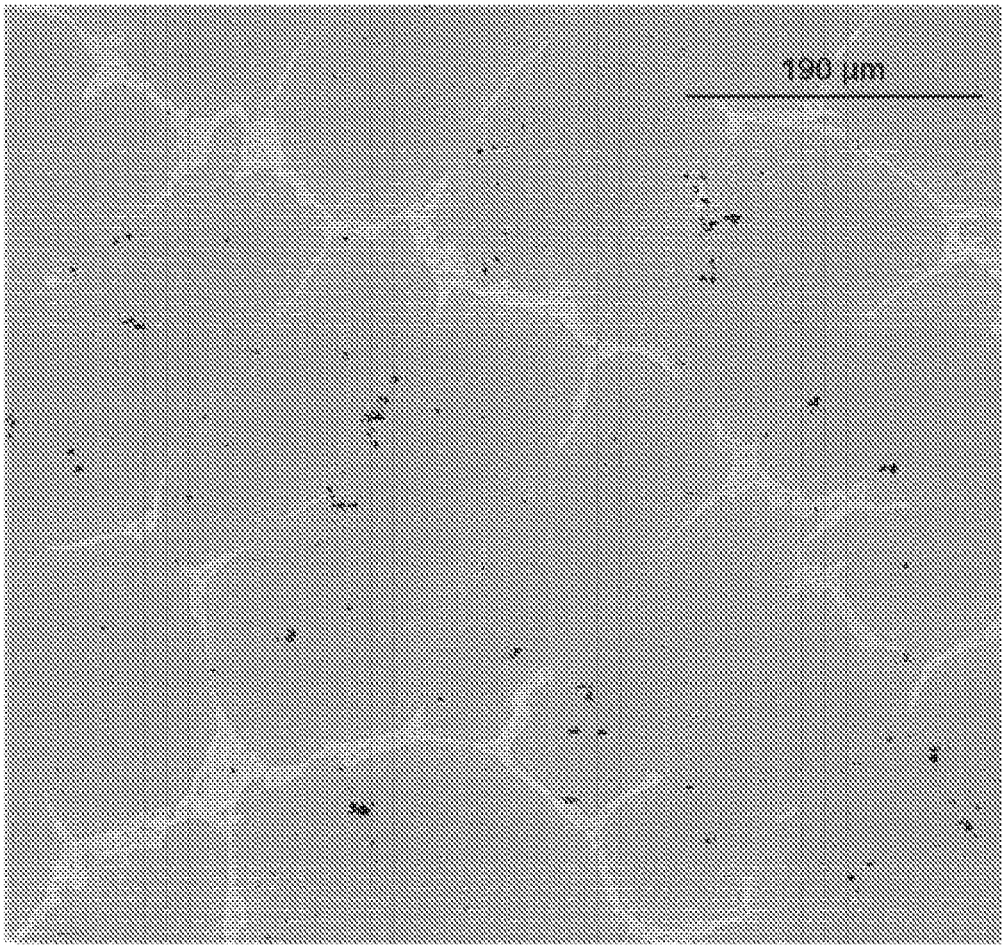
Figure 26:
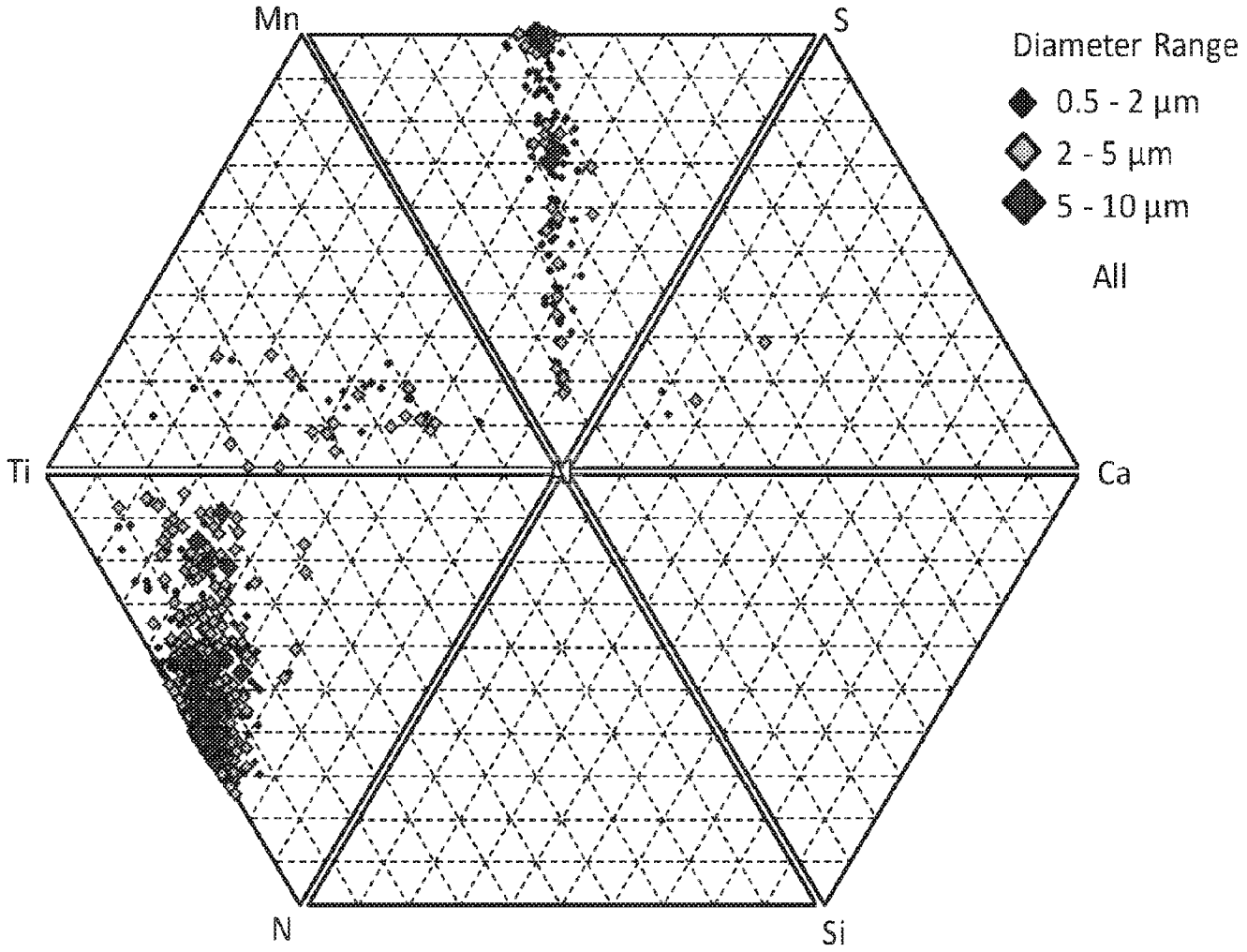
FIG. 26 is a joint ternary plot of precipitate composition in heat T1 as described in below Example 5.

Primary melt treatment to form targeted dispersoids before titanium treatment as with heat T2 changed the reaction sequence and significantly increased the amount of TiN precipitates. TiN precipitates were often precipitated onto complex oxides and later MnS formed on TiN surface (FIG. 23). Some precipitates were pure TiN without visible core or outside layers of other compositions (FIG. 24). These had a tendency to cluster inside grains as well as at interdendritic regions (FIG. 25). The joint ternary diagram of FIG. 26 shows different classes of the precipitates formed. Many of the clustered TiN precipitates were above 5 microns diameter.

Figure 27:
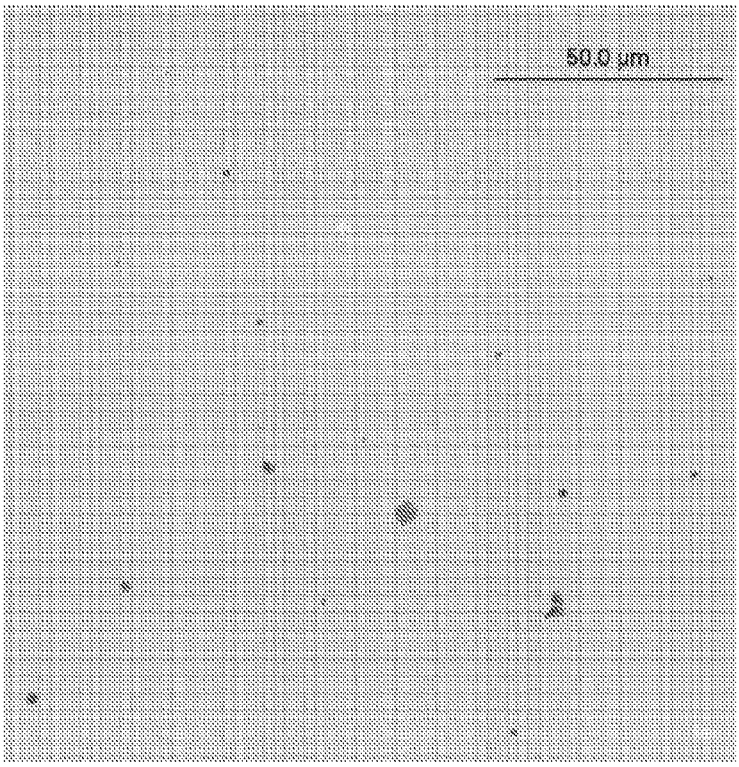
Figure 28:
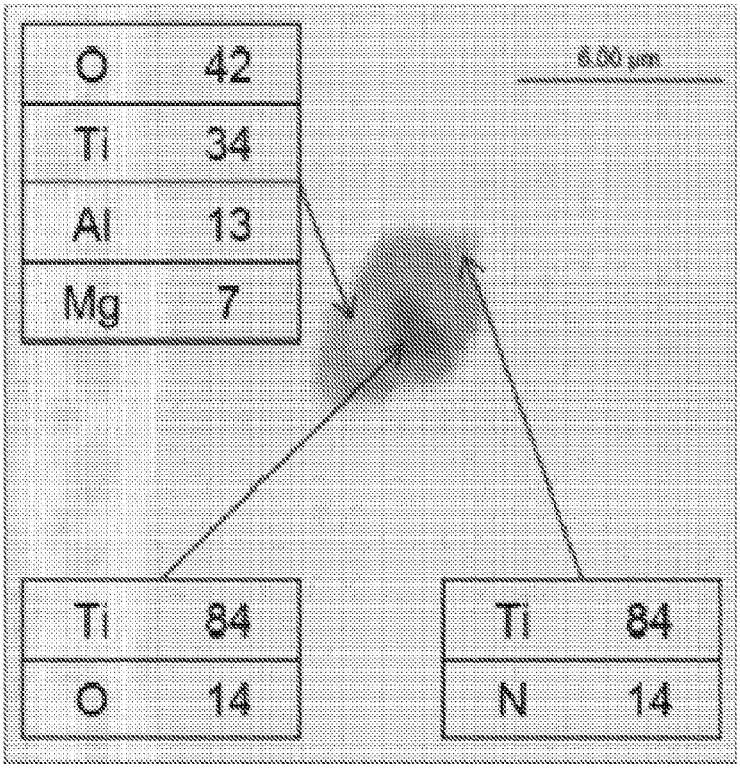
Figure 29:
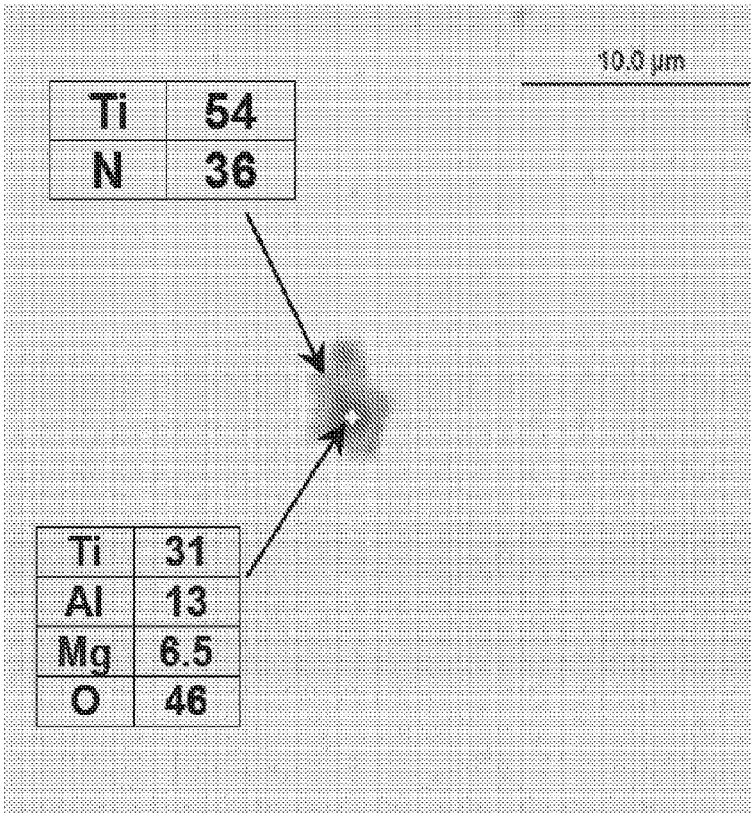
Figure 30:
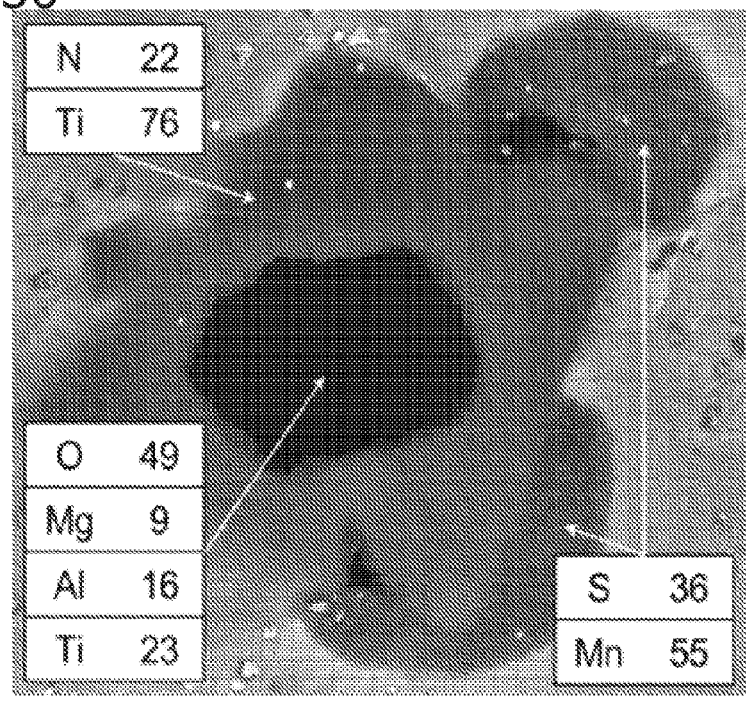
Figure 31:
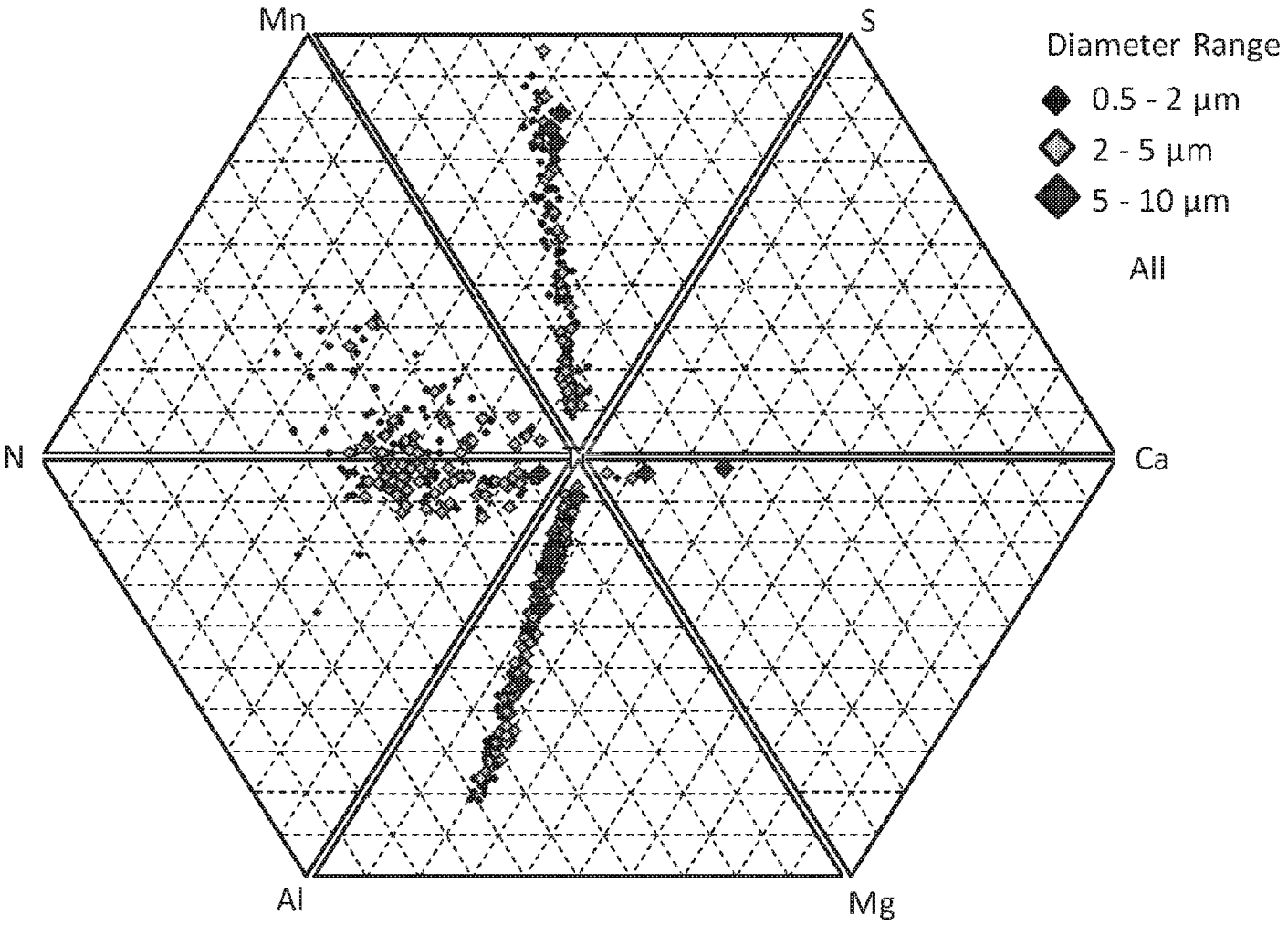
FIG. 31 is a joint ternary plot of precipitate composition in heat T3 as described in below Example 5.

It can be seen from FIGS. 27-31 that the melt treatment method in heat T3 had a significant effect on dispersoid population, internal structure and chemical composition of the precipitates. The reaction products were evenly distributed in the matrix (FIG. 27). FIG. 28 shows TiN formed on complex Ti—Mg—Al oxides. FIG. 29 shows TiN formed on complex Mg—Al spinel. FIG. 30 shows complex TiN precipitated with outside MnS layers. And FIG. 31 is a joint ternary plot of precipitate composition. The majority of TiN bearing precipitates had cores consisting of oxides that were compositionally close to $MgAl_2O_4$ spinel or more complex Mg, Al, and Ti oxide compounds. The layering structure of the observed precipitations follows the reaction sequence predicted thermodynamically. The structure of the dispersoids indicated on a sequential precipitation mechanism of its formation: strong oxides formed first, followed by later formed TiN. And finally, near solidification temperature, MnS partially coated TiN surfaces. Joint ternary diagrams clearly indicate that the precipitates have a core with $MgAl_2O_4$ spinel stoichiometry.

Example 6

This experimental example was performed to demonstrate the efficiency of the invention for preparing cast austenitic 316 stainless steel. An experimental heat was prepared having the composition in Table 6.

TABLE 6

| Composition of experimental heat, wt % | | | | | | |
|---|---|---|---|---|---|---|
| C | Cr | Ni | Mn | Si | Mo | Fe |
| 0.05 | 16.5 | 11 | 0.9 | 0.9 | 1.7 | Bal. |

A first charge of the material was processed as a base heat and a second charge of the material was processed as an inventive heat in accordance with the invention for comparison purposes. In the inventive heat, Al and Mg were added to the ladle to form oxide dispersoid compounds in situ. Additions of Al and Mg were followed by addition of Ti for forming TiN sequential precipitates on the dispersoids. There was a dwell time of 10 to 20 seconds between discontinuing the Al and Mg additions and beginning the Ti additions to allow the dispersoid formation to run its course.

Figure 32:
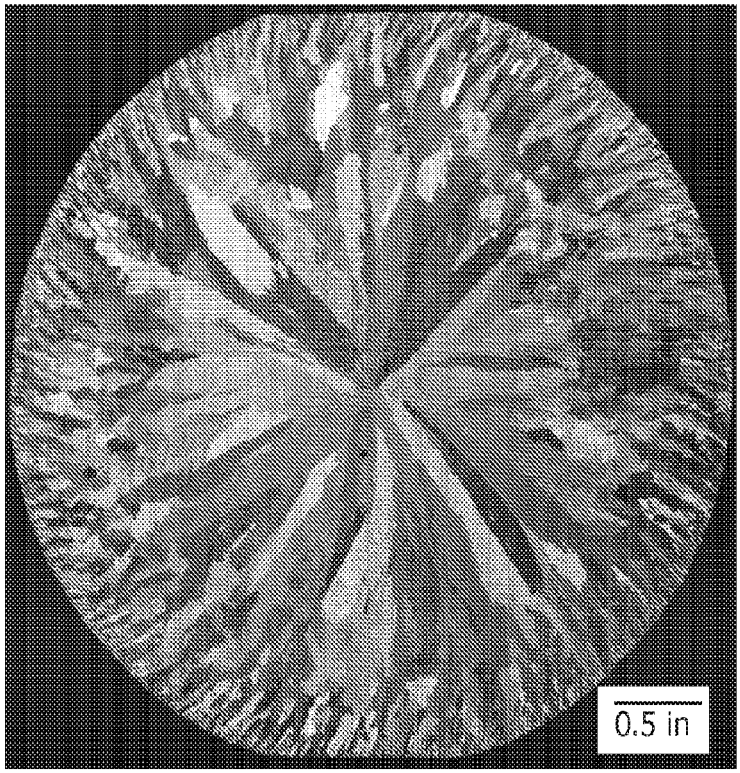
FIG. 32 is a photograph showing the microstructure of the basic heat in below Example 6, in horizontal cross section.
Figure 33:
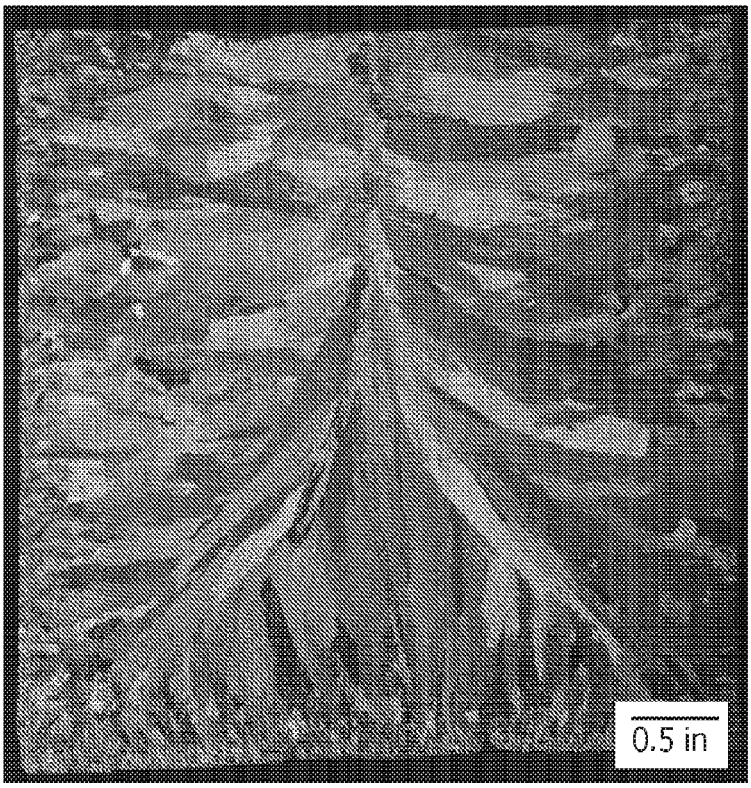
FIG. 33 is a photograph showing the microstructure of the basic heat in below Example 6, in vertical cross section.
Figure 34:
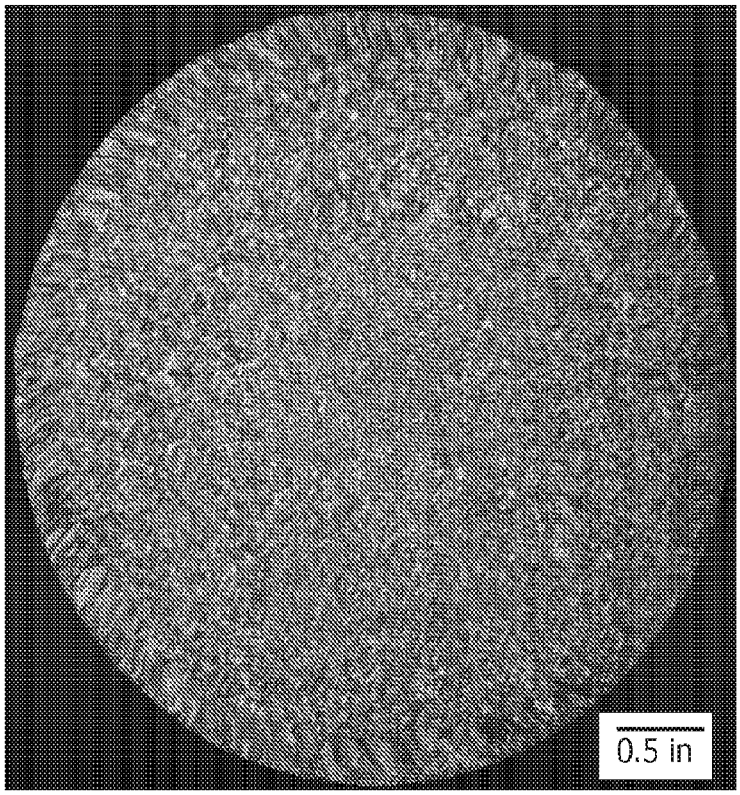
FIG. 34 is a photograph showing the microstructure of the inventive heat in below Example 6, in horizontal cross section.
Figure 35:
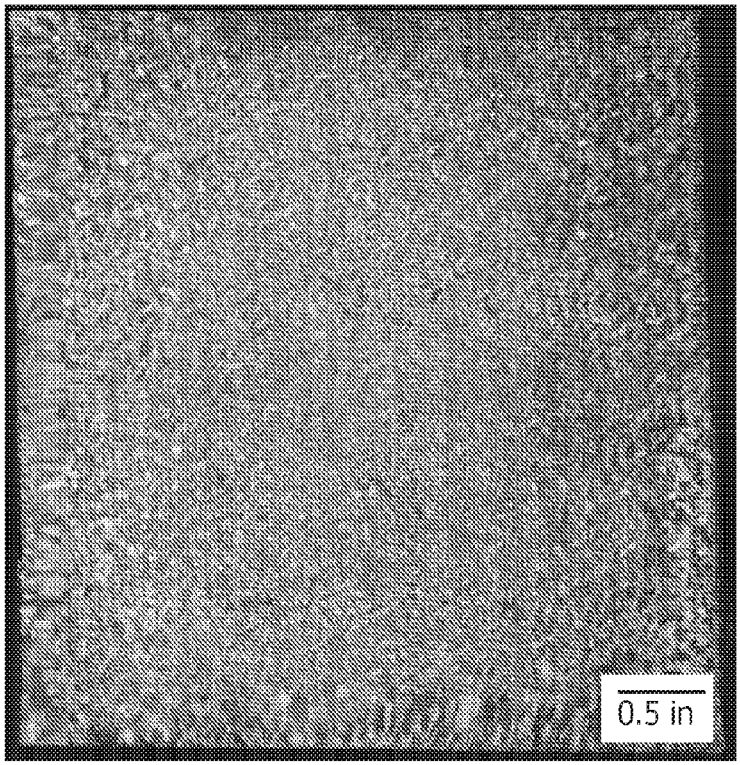
FIG. 35 is a photograph showing the microstructure of the inventive heat in below Example 6, in vertical cross section.

Horizontal and vertical metallographic cross sections of the base heat are shown in FIGS. 32 and 33, respectively. Horizontal and vertical cross sections of the inventive heat are shown in FIGS. 34 and 35, respectively. It can be seen that the base heat microstructure had a high proportion of large columnar grains, with essentially no significant equiaxed zone. Horizontal and vertical cross sections of the inventive heat are shown in FIGS. 34 and 35, respectively. The microstructure is predominantly fine equiaxed grains. The grain refining factor (R) was calculated as discussed above. For the base heat, R was 0 because there was no equiaxed zone. For the inventive heat, the D(equiaxed) was 0.8 to 1 mm and R was calculated to be 0.82.

It can therefore be seen from the foregoing that the inventors have discovered that heterogeneous nucleation can be enhanced by controlling the sequence of precipitate formation in the melt. This technique produced a strong grain refining effect in cast superaustenitic steel and other iron-based alloys.

Heterogeneous nucleation in the present invention is enhanced by the creation of a low energy dispersoid/solidified matrix interface, which is also related to a small wetting angle. Low interfacial energy has been stated to correspond to a small lattice disregistry:

TABLE 5

| Lattice disregistry for different precipitate interfaces | | | | |
|---|---|---|---|---|
| | Lattice | Planar disregistry, % | | |
| Compound | parameter at 2800° F., Å | δ-Fe ($\alpha_0$ = 2.9315) | γ-Fe ($\alpha_0$ = 3.6988) | TiN |
| TiN | 4.308 | 3.9 | 7.7 | — |
| $MgAl_2O_4$ | 4.098 | 1.2 | — | 4.9 |
| MgO | 4.310 | 4.0 | — | 0.0053 |
| $Ti_2O_3$ | 5.225 | 18.9 | — | 16.2 |
| $Al_2O_3$ | 4.825 | 10.4 | — | 17.48 |

J. S. Park, *Steel Research Int.*, 85 (2014) No. 9999

The lattice parameter of TiN is close to δ-Fe. However, there is a larger disregistry with γ-Fe, which could explain the more difficult grain refinement of Cr—Ni alloyed austenitic steel when compared to Cr-alloyed ferritic steels. It appears that a small lattice disregistry could indicate a low TiN/MgO and TiN/$MgAl_2O_4$ interfacial energy, which will facilitate the observed sequential precipitation of TiN on spinel cores. Initiation of precipitation of TiN by $MgAl_2O_4$ spinel precipitates was observed to have a large effect on the population density of precipitates.

To be active during solidification, the targeted dispersoids for heterogeneous nucleation must survive in the melt before the solidification of the base material. The thermodynamic calculations of the multiple reactions, which can occur during melt treatment, were used to predict the reaction sequences and invent a treatment schedule to precipitate the targeted dispersoids. Experimental results supported thermodynamic predictions. Compounds of MgO and $MgAl_2O_4$ spinel were precipitated from the melt first and were followed by sequential precipitation of TiN during melt cooling. Nitrogen level in initial melt is important to control the start precipitation temperature of TiN and the total amount of targeted dispersoid formed. In certain preferred embodiments of this invention, the N level in the melt following dispersoid precipitation is between about 400 and about 3000 ppm, such as between about 600 and about 900 ppm.

The present invention yields steels having a microstructure which is at least 50% equiaxed grains by volume, such as at least about 60 vol %, for example between 60 and 85 vol % equiaxed structure. The equiaxed grain structure has an average grain size of between about 0.3 and 5 mm, for example between about 0.5 and 5 mm, such as between about 0.5 and 4 mm, between about 0.5 and 3 mm, or between about 0.5 and 2 mm.

This grain refinement in the invention is achieved, remarkably, with a very low volume of additions. In particular, by conventional techniques a large quantity of additives would be required to form surfaces for heterogeneous nucleation sufficient to achieve more than 50% equiaxed grains and/or an equiaxed grain size of less than 5 mm. But by forming oxide-based or carbide-based dispersoids in situ, their formation is highly dispersed, of small size, of high surface area, and achieved in part using elements already in the melt. By using elements already in the melt for dispersoid formation and relying only in part on external additions of Al, Ca, and Mg, the dispersoids can be formed without significant detrimental alteration of the overall melt chemistry and with minimizing additional energy input for melting additional material mass.

In view of the above, it will be seen that the several objects of the invention are achieved and other advantageous results obtained.

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above compositions and methods without departing from the scope of the invention, it is intended that all matter contained in the above description and shown in the accompanying drawings shall be interpreted as illustrative and not in a limiting sense.

The invention claimed is:

1. A process for manufacturing an austenitic stainless steel comprising, in sequence:

a) feeding iron-bearing material into a melting furnace and melting the iron-bearing material into molten metal;

b) introducing elements into the molten metal to react with dissolved oxygen and/or carbon in the molten metal to form targeted oxide and/or carbide dispersoids in the molten metal;

c) after said forming of the targeted oxide and/or carbide dispersoids in the molten metal, maintaining the molten metal at a temperature above a liquidus temperature of the molten metal and introducing one or more metal grain refiner elements into the molten metal to precipitate metal nitrides of the metal grain refiner elements to yield a molten metal containing the metal nitrides; and d) cooling the molten metal containing said metal nitrides therein to a temperature below the solidus temperature of the molten metal to form solidified austenitic stainless steel.

2. The process of claim 1 wherein the elements added in step (b) to form targeted oxide dispersoids comprise one or more elements selected from the group consisting of Al, Ba, Ca, Mg, Sr, and Ti.

3. The process of claim 1 wherein the elements added in step (b) to form targeted oxide dispersoids comprise one or more elements selected from the group consisting of Al and Mg and the oxide dispersoids comprise Mg oxide and/or Al oxide compounds, and wherein the dispersoids occupy an overall concentration in the melt of from 1 to 1000 ppm.

4. The process of claim 3 wherein the austenitic stainless steel has a microstructure which is at least 50% equiaxed grains by volume having an average grain size of between 0.3 and 5 mm.

5. The process of claim 1 wherein the oxide dispersoids comprise MgO and magnesium aluminate in a form of $MgAl_2O_4$ and/or MgO—$Al_2O_3$ which facilitate precipitation of the nitrides.

6. The process of claim 1 wherein said metal nitrides are nucleation sites for forming refined metal grains during the cooling to form the solidified austenitic stainless steel.

7. The process of claim 1 wherein said metal nitrides are heterogenously dispersed nucleation sites for forming refined equiaxed metal grains during the cooling to form the solidified austenitic stainless steel.

8. The process of claim 1 wherein the one or more metal grain refiner elements comprises one or more transition metal elements.

9. The process of claim 8 wherein the one or more metal grain refiner elements comprises one or more elements selected from the group consisting of Hf, Nb, Ti, and Zr.

10. The process of claim 8 wherein the one or more metal grain refiner elements comprises Ti.

11. The process of claim 8 wherein Ti is the only metal grain refiner element introduced into the molten metal between of steps (b) and (d).

12. The process of claim 1 further comprising, prior to step (b), partially deoxidizing by i) adding one or more deoxidizing elements which form oxide compounds and ii) removing oxide compounds from the molten metal in order to establish a targeted oxygen concentration in the molten metal.

13. The process of claim 12 comprising adding the one or more deoxidizing elements during step (a).

14. The process of claim 12 comprising adding the one or more deoxidizing elements between steps (a) and (b).

15. The process of claim 12 wherein the removing oxide compounds comprises removing one or more of Al oxides, Ca oxides, and Si oxides.

16. The process of claim 12 wherein the deoxidizing elements comprise elements selected from the group consisting of Al and Ca.

17. The process of claim 1 wherein the metal nitrides are precipitated onto the dispersoids and the metal nitrides provide surfaces for heterogeneous nucleation and grain refinement of equiaxed grains upon cooling.

18. The process of claim 1 wherein the N level in the melt at a time of addition of the one or more grain refiner elements is between about 600 and 900 ppm.

19. The process of claim 1 wherein the solidified austenitic stainless steel has a microstructure which is between 60 and 85 vol % equiaxed structure.

20. The process of claim 1 wherein the solidified austenitic stainless steel has an equiaxed grain structure which has an average grain size of between about 0.5 and 2 mm.

21. The process of claim 1 wherein the austenitic stainless steel has a microstructure which is at least 50% equiaxed grains by volume having an average grain size of between 0.3 and 5 mm.

22. A process for manufacturing an iron-based alloy comprising, in sequence:

a) feeding iron-bearing material into a melting furnace and melting the iron-bearing material into molten metal;

b) introducing elements into the molten metal to react with dissolved oxygen and/or carbon in the molten metal to form targeted oxide and/or carbide dispersoids in the molten metal;

c) after said forming of the targeted oxide and/or carbide dispersoids in the molten metal, maintaining the molten metal at a temperature above a liquidus temperature of the molten metal and introducing one or more metal grain refiner elements into the molten metal to precipitate metal nitrides of the metal grain refiner elements to yield a molten metal containing the metal nitrides; and d) cooling the molten metal with said metal nitrides therein to a temperature below the solidus temperature of the molten metal to form solidified iron-based alloy, wherein:

the elements added in step (b) are selected from the group consisting of Al and Mg to form oxide dispersoids of MgO and magnesium aluminate in a form of $MgAl_2O_4$ and/or $MgO—Al_2O_3$ which facilitate precipitation of the nitrides;

the process further comprises, after step (b) and prior to initiating step (c), terminating addition of the elements selected from Al and Mg and subjecting the molten metal to a dwell time of at least 10 seconds before initiating step (c);

the solidified iron-based alloy is an austenitic steel which has a microstructure which is between 60 and 85 vol % equiaxed structure having an average grain size of between about 0.5 and 3 mm.

* * * * *